US012669030B2

(12) United States Patent
Nguyen et al.

(10) Patent No.: US 12,669,030 B2
(45) Date of Patent: Jun. 30, 2026

(54) REGULATING DISTRIBUTION OF INJECTION AND PRODUCTION FLUIDS TO ENHANCE HEAT RECOVERY IN GEOTHERMAL APPLICATIONS

(71) Applicant: Halliburton Energy Services, Inc., Houston, TX (US)

(72) Inventors: Philip D. Nguyen, Duncan, OK (US); Ronald Glen Dusterhoft, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 105 days.

(21) Appl. No.: 18/793,168

(22) Filed: Aug. 2, 2024

(65) Prior Publication Data

US 2026/0036015 A1 Feb. 5, 2026

(51) Int. Cl.

| | |
|---|---|
| ***E21B 33/13*** | (2006.01) |
| ***E21B 47/07*** | (2012.01) |
| ***E21B 47/135*** | (2012.01) |
| ***F24T 50/00*** | (2018.01) |

(52) U.S. Cl.

CPC ..... *E21B 33/13* (2013.01); *E21B 47/07* (2020.05); *E21B 47/135* (2020.05); *F24T 50/00* (2018.05)

(58) Field of Classification Search

CPC ..... E21B 33/13; E21B 47/07; E21B 47/06; E21B 47/10; E21B 33/138; E21B 43/26; C09K 23/38; C09K 8/05; F24T 50/00; F24T 10/00

See application file for complete search history.

(56) References Cited

U.S. PATENT DOCUMENTS

| | | | |
|---|---|---|---|
| 4,438,976 | A | 3/1984 | Baughman et al. |
| 7,345,011 | B2 | 3/2008 | Nguyen et al. |
| 7,794,537 | B2 | 9/2010 | Barlet-Gouedard et al. |
| 8,613,320 | B2 | 12/2013 | Nguyen et al. |
| 9,027,648 | B2 | 5/2015 | Sanders et al. |

(Continued)

FOREIGN PATENT DOCUMENTS

WO WO-2010123566 A1 * 10/2010 ..... E21B 43/2406

OTHER PUBLICATIONS

Foreign Communication from Related Application—International Search Report and Written Opinion of the International Searching Authority, International Application No. PCT/US2025/031676, dated Sep. 19, 2025, 11 pages.

(Continued)

*Primary Examiner* — Daniel P Stephenson
(74) *Attorney, Agent, or Firm* — Conley Rose, P.C.; Rodney B. Carroll

(57) ABSTRACT

A method of improving heat recovery from a geothermal well includes receiving temperature distribution data from a distributed temperature sensing (DTS) system comprising a fiber optic cable disposed in a wellbore, which extends through a formation; analyzing the temperature distribution data to determine a fluid flow profile along the wellbore; determining, based on the fluid flow profile, a location of dominant flow rate; and injecting a sealing agent into the formation at the location. When the sealing agent cures, fractures within a fracture system are sealed in the formation at the location. The cured sealing agent prevents or mitigates fluid flow through the formation at the location.

20 Claims, 16 Drawing Sheets

(56) References Cited

U.S. PATENT DOCUMENTS

| | | | | |
|---|---|---|---|---|
| 9,388,667 | B2 * | 7/2016 | Orrego | E21B 36/005 |
| 9,605,534 | B2 * | 3/2017 | Chen | E21B 47/103 |
| 9,726,157 | B2 | 8/2017 | Sweatman et al. | |
| 10,927,604 | B2 | 2/2021 | Danko | |
| 11,162,015 | B2 | 11/2021 | Pisklak et al. | |
| 11,226,137 | B2 | 1/2022 | O'Malley et al. | |
| 11,345,848 | B2 | 5/2022 | Khamatnurova et al. | |
| 11,434,740 | B1 | 9/2022 | Ngyuen et al. | |
| 11,585,330 | B1 * | 2/2023 | Steele | E21B 34/06 |
| 11,808,121 | B2 | 11/2023 | Norbeck et al. | |
| 11,851,608 | B2 | 12/2023 | Nguyen et al. | |
| 11,953,238 | B1 | 4/2024 | Moncarz et al. | |
| 11,959,666 | B2 | 4/2024 | Fleckenstein | |
| 11,976,236 | B2 * | 5/2024 | Evans | C09K 8/035 |
| 12,247,470 | B1 * | 3/2025 | Alcantar | E21B 43/17 |
| 2006/0243438 | A1 * | 11/2006 | Brown | E21B 49/008 166/250.02 |
| 2015/0300327 | A1 | 10/2015 | Sweatman et al. | |
| 2018/0037803 | A1 * | 2/2018 | Dahi Taleghani | E21B 43/267 |
| 2018/0058209 | A1 * | 3/2018 | Song | G01P 5/16 |
| 2019/0203574 | A1 * | 7/2019 | Yi | E21B 43/11 |
| 2019/0241472 | A1 | 8/2019 | Kondratowicz et al. | |
| 2020/0011151 | A1 * | 1/2020 | Toews | E21B 33/138 |
| 2021/0238985 | A1 * | 8/2021 | Yerubandi | E21B 47/135 |
| 2022/0162935 | A1 | 5/2022 | Nguyen et al. | |
| 2023/0220267 | A1 | 7/2023 | Stormont et al. | |
| 2023/0235208 | A1 | 7/2023 | Evans et al. | |
| 2023/0288099 | A1 * | 9/2023 | Toews | H02J 3/28 |
| 2023/0313652 | A1 * | 10/2023 | Benson | E21B 17/18 166/251.1 |
| 2024/0102372 | A1 | 3/2024 | Dahi Taleghani | |
| 2025/0067482 | A1 * | 2/2025 | McChesney | F24T 10/30 |
| 2025/0368882 | A1 * | 12/2025 | Jones | C09K 8/467 |
| 2026/0036015 | A1 * | 2/2026 | Nguyen | E21B 33/13 |

OTHER PUBLICATIONS

Qitao Zhang et al., "Downhole Flow Management to Enhance Efficiency of Fractured Geothermal Systems in Horizontal Wells." Proceedings, 49th Workshop on Geothermal Reservoir Engineering Stanford University, Stanford, California, Feb. 12-14, 2024 SGP -TR-227. pp. 1-7.

Michal Kruszewski et al., "Alkali-activated aluminosilicate sealing system for deep high-temperature well applications." HRWKHUPLFV 89 (2021) 101935. Published by Elsevier Ltd. 2020. 10 pages.

Baron Bustin et al., First Regional Selective Packerless Acid Fracture Stimulation With Coiled Tubing: A Documented Case History From Saudi Arabia. SPE 120938 Mar. 31, 2009-Apr. 1, 2009. The Woodlands, TX. 16 pages.

* cited by examiner

REGULATING DISTRIBUTION OF INJECTION AND PRODUCTION FLUIDS TO ENHANCE HEAT RECOVERY IN GEOTHERMAL APPLICATIONS

CROSS-REFERENCE TO RELATED APPLICATIONS

None.

STATEMENT REGARDING FEDERALLY SPONSORED RESEARCH OR DEVELOPMENT

Not applicable.

BACKGROUND

Geothermal power plants utilize geothermal wells to extract heat from underground reservoirs. In subterranean formations, high permeability streaks can cause all other fluid flow paths to concentrate into these flow streaks and exit at a focal point, which may cause an early fluid breakthrough. Long, horizontal wells can create non-uniform heat and flow across the reservoir due to variations in formation permeabilities along the wellbore, which can accelerate thermal short-circuiting and early thermal breakthrough. In enhanced geothermal systems (EGS), highly conductive fractures can negatively impact the reservoir sweep efficiency. Heat harvesting through horizontal wells with abundant fractures or system of fractures often result in the thermal short-circuiting, thereby causing inefficiency of heat delivery to the surface. The system and method of the present disclosure may address one or more of these issues.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

FIG. 16 is a graph of the temperature profile in the injection wellbore and the temperature profile in the production wellbore before the sealing operation, according to an embodiment.

DETAILED DESCRIPTION

Figure 1:
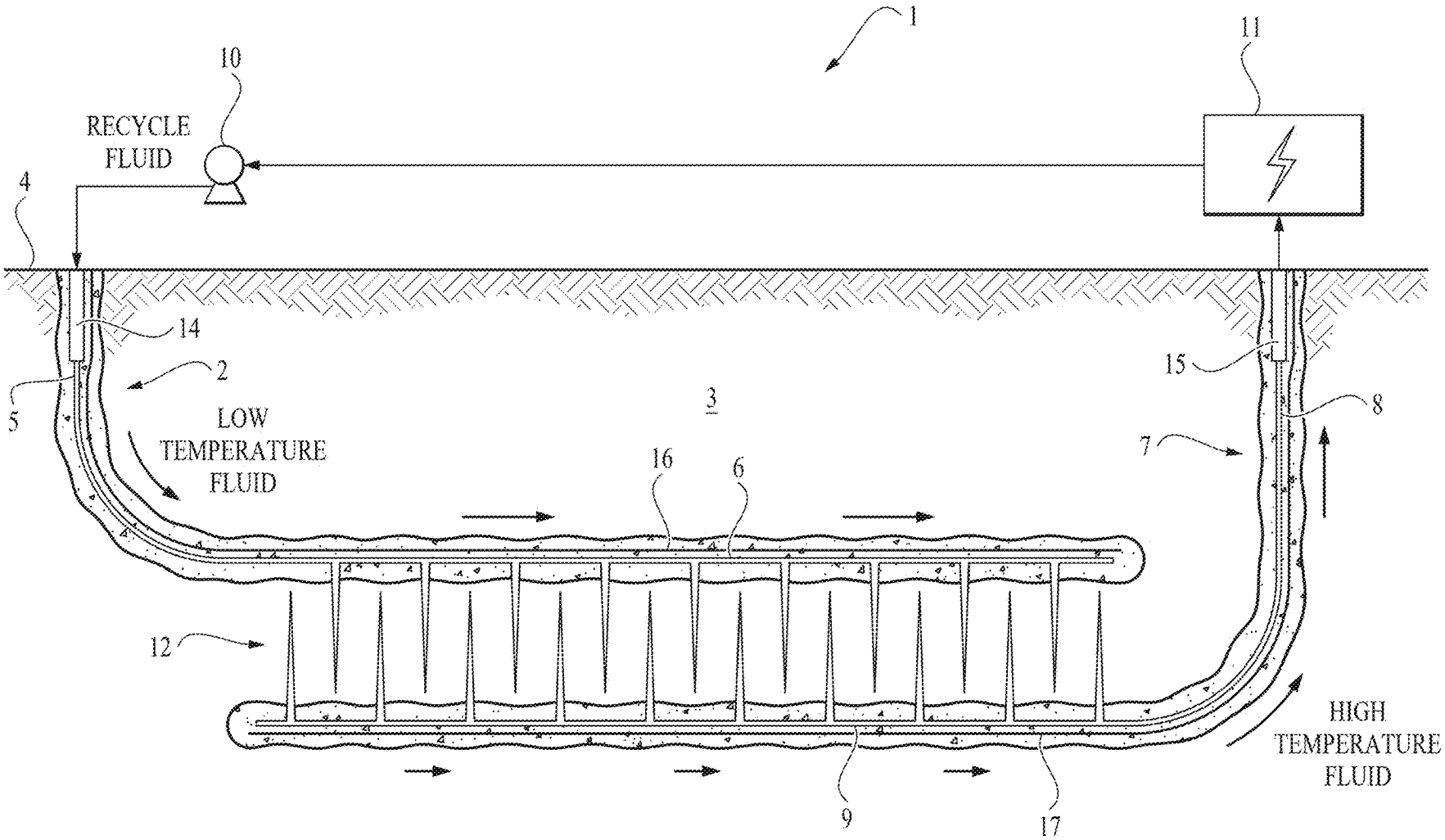
FIG. 1 is a schematic diagram of a geothermal well, according to an embodiment of the present disclosure.

It should be understood at the outset that although illustrative implementations of one or more embodiments are illustrated below, the disclosed systems and methods may be implemented using any number of techniques, whether currently known or not yet in existence. The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description. The disclosure should in no way be limited to the illustrative implementations, drawings, and techniques illustrated below, but may be modified within the scope of the appended claims along with their full scope of equivalents.

As used herein the terms "uphole", "upwell", "above", "top", and the like refer directionally in a wellbore towards the surface, while the terms "downhole", "downwell", "below", "bottom", and the like refer directionally in a wellbore towards the toe of the wellbore (e.g. the end of the wellbore distally away from the surface), as persons of skill will understand. Orientation terms "upstream" and "downstream" are defined relative to the direction of flow of fluid, for example relative to flow of well fluid in the well. As used herein, orientation terms "upstream," "downstream," are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid.

In some embodiments, the system and method of the present disclosure improves efficiency of a geothermal power plant by controlling flow between an injection well and a production well. The geothermal wells may use circulation to carry heat from heat dry rock via hydraulic stimulations. High-pressure fluid may be injected into the reservoir to create new fractures and/or activate preexisting natural fractures, resulting in a system of fractures or a man-made permeable reservoir, thereby accommodating increased fluid flow and bringing more heat to the surface.

Heat extraction from the reservoir may be maximized by promoting uniform flow distribution, which may include evenly distributing fluid influx across the entire length of the wellbore, including zones with propped fractures.

The system and method of the present disclosure may promote efficient sweeping of geothermal fluids across the entire reservoir section, including areas with propped fractures, maximizing contact with hot rock formations and maximizing energy extraction. The method may comprise installing fiber optic distributed temperature sensors (DTS) in the injection well, in the production well, or both, to analyze the temperature distribution data, thereby obtaining fluid production profile along the wellbore length. After determining locations of dominant flow rates of production fluid by detecting relatively low temperatures, a sealing agent may be placed into the locations of dominant flow rates to seal or mitigate the production of low temperature fluid in the locations. By controlling flow rates, the preferential flow paths are prevented, which may ensure that fluids are extracted uniformly from both the fractures or system of fractures and the surrounding reservoir matrix. This can help optimize heat recovery and prevent premature fluid breakthrough in specific zones that have low heat recovery.

In some embodiments, a method of controlling flow rates of production fluid from production wellbore for enhancing heat recovery from a geothermal reservoir comprises providing a geothermal operation system comprising an injection wellbore and a production wellbore, wherein the wellbores are configured parallel to each other, allowing fluid flowing from the injection well into the production well for harvesting reservoir heat. The wellbores may have been completed as open holes, cased and perforated, and/or prop-fractured in multiple intervals along their lengths. The method may further include installing a DTS in the production wellbore for detecting temperature distribution along the length of the wellbore. The method may further include analyzing the temperature distribution to determine locations of high production fluid flow rates (often with low temperatures indicating early fluid breakthrough (i.e., short circuiting) along the wellbore length). The method may further include injecting a sealing agent capable of withstanding high temperatures during geothermal operations into locations of high flow rates with potential of causing short circuiting. The method may further include allowing the sealing agent to cure at reservoir temperature, transform into a rigid solid for sealing off or mitigating fluid production in these the locations, forcing it to divert and move into lower production zones. The method may further include allowing the production fluid to sweep larger formation area to effectively adsorb more heat from the reservoir as illustrated in FIG. 1.

To generate electricity, low-temperature fluid may be injected from the injection wellbore. The fluid may adsorb heat in the reservoir formation to be transformed into a heat-treated fluid before it is produced back via production wellbore to drive the turbo-expander for generating electricity. The sealing agent may be placed into the propped fractures that have been determined to cause short circuiting (i.e., early breakthrough of low-temperature fluid) to shut off the fluid production from these fractures.

In some embodiments, the sealing agent comprises an aqueous-based binder composition comprising a water (brine), a furfuryl alcohol monomer, an optional particulate filler, an oil-wetting surfactant, and/or a silane coupling agent. Once penetrated at an interval of high production flow rates in the formation sand or propped fractures, the aqueous-based binder composition may polymerize and transform into a solid sealant capable of sealing off the interval, thereby preventing or mitigation the high flow rate of production fluid, allowing it to divert and sweep larger formation area to adsorb more heat from the reservoir.

In some embodiments, the sealing agent comprises a furan-based resin comprising a furan resin, a solvent diluent, a particulate filler, an oil-wetting surfactant, and/or a silane coupling agent. At temperature 300° F. and above, furan resin may self-activate without requiring an activator to transform into a solid sealant capable of sealing off the interval, thereby preventing or mitigating the high flow rate of production fluid, allowing it to divert and sweep a larger formation area to adsorb more heat from the reservoir. The furan resin may withstand temperatures of up to 700° F.

In some embodiments, the sealing agent comprises a curable geopolymer composition comprising an aqueous base fluid, an aluminosilicate, a metal silicate, and/or an alkali metal activator. The aluminosilicate source may be a metakaolin clay, the metal silicate source may be a sodium silicate, and/or the activator may be sodium hydroxide. Other suitable aluminosilicate sources may include, but are not limited to, calcined clays, partially calcined clays, kaolinite clays, lateritic clays, illite clays, volcanic rocks, mine tailings, blast furnace slag, and coal fly ash.

The fiber optic cable can be a permanent installation on outside of the casing. It can be cemented in place (e.g., as part of the completion). It could be disposed on tubing or casing or part of completion. It could alternatively be inserted in capillary tubing (e.g., quarter inch tubing). Fluid may be pumped down the tube at a slow rate to carry the fiber optic cable down. Alternatively, it could be disposed on the production tubing.

In some embodiments, there are two fiber optic cables. One fiber optic cable may be in the production wellbore, and one fiber optic cable may be in the injection wellbore. Temperature readings from each fiber optic cable can be compared. Based on this comparison, efficiency of thermal recovery may be estimated.

In some embodiments, the method may include determining that there are higher flow rates in areas with lower temperatures. The method may further include determining that there is a breakthrough in the formation in the areas of higher flow rates/lower temperatures. In some embodiments, the method may include determining that a breakthrough is in an area of high temperature gradient in an injection wellbore. The method may include inferring that a lot of cooling at that point means that a lot of fluid is being lost. The method may include placing sealant until a linear gradient in temperature loss is achieved.

In some embodiments, a cyclic production cycle can be used in which injection is started and stopped at certain points in time. This may force fluid into secondary fracture areas. In some embodiments, an alert will sound in response to a processor determining there is a problem with communication (e.g., a problem with flow through the formation). The processor may implement any method disclosed herein to determine that there is a problem (e.g., non-ideal flow).

The method can take into account that with high flow rate, there will be some warmup from the heated fluid passing by the formation. The method may include determining that there is a high leak-off point where there is a rapid warmup along the length.

In some embodiments, sealant is put in place by using a coil tubing, which can pinpoint injection into local target area. In some embodiments, a slug of sealant is pumped down the injection wellbore while temperature is monitored by the fiber optic cable. When coil tubing is used, a plug may isolate an area. For example, there may be a top and bottom isolator. The tool at end of coil tubing may have packers and an injection outlet between the two packers. In some well environments, temperatures could exceed elastomer capabilities of the packers, so use dynamic diversion can be used with a jetting tool. The jetting tool may have a side jet. The side jet may be positioned over area where the communication is. The side jet and/or the injection may be fine tune it by monitoring fiber while injecting water through that jet. This may create a low-pressure zone to isolate flow for selective injection into the reservoir. In some embodiments, the sealant is pumped slowly down the annulus. In some embodiments, the sealant is pumped down the tubing and the jet is used to place it in the appropriate position.

In some embodiments, the sealant is placed on injection side. Production can continue as the sealant is being placed so that the flow can aid placement of the sealant. After the sealant is in place, both injection and production can be stopped to allow the sealant time to cure. In some embodiments, sealant is placed on the production side using a jet.

FIG. 1 illustrates an exemplary geothermal power plant 1. There may be an injection wellbore 2 drilled into a subterranean formation 3 from the surface 4. The injection wellbore 2 may include a vertical portion 5 extending from the surface 4 and a horizontal portion 6 extending from the vertical portion 5. A production wellbore 7 may be drilled into the subterranean formation 3 from the surface 4. The production wellbore 7 may include a vertical portion 8 extending from the surface 4 and a horizontal portion 9 extending from the vertical portion 8.

The injection wellbore 2 may be coupled to an injection pump 10. The production wellbore 7 may be coupled to an electrical generator 11, for example, a turbine generator. In some embodiments, the horizontal portion 9 of the production wellbore 7 may be parallel to the horizontal portion 6 of the injection wellbore 2. In some embodiments, the horizontal portion 6 of the injection wellbore 2 and the horizontal portion 9 of the production wellbore 7 may be within a range of 50 to 1000 feet of one another.

During a geothermal operation (e.g., running of the geothermal power plant 1), a circulating fluid (e.g., the flow of circulating fluid indicated by arrows) comprising water may be injected into the injection wellbore 2, absorb heat from the formation 3, and be recovered from the production wellbore 7. The circulating fluid can circulate from the injection wellbore 2 and into the production wellbore 7 via adjacent fractures or system of fractures 12 associated with injection wellbore 2 and the production wellbore 7. After absorbing heat in the formation 3, the heated circulating fluid can exit the production wellbore 7 through the production outlet 15. Heat can then be extracted from the circulating fluid. For example, the heated circulating fluid can be passed through the electricity generator 11 (e.g., one or more turbine generators) and/or associated components, wherein the heat can be utilized to produce electricity. A heat exchanger and/or a condenser may be used to extract the heat. For example, the circulating fluid (e.g., water) may be run through the heat exchanger, which may be associated with the electric generator 11. In the heat exchanger, the circulating fluid (e.g., water) may transfer heat to a secondary fluid (e.g., isobutane or isopentane) with a lower boiling point than water. Due to the transfer of heat, the secondary fluid may vaporize and the vapor may drive a turbine of the electricity generator 11. After the heat transfer, the relatively cool circulating fluid can be pumped by the injection pump 10, through the injection inlet 14, and back into the injection wellbore 2. The electric generator 11 may be configured to provide electric power to a power grid.

Figure 2:
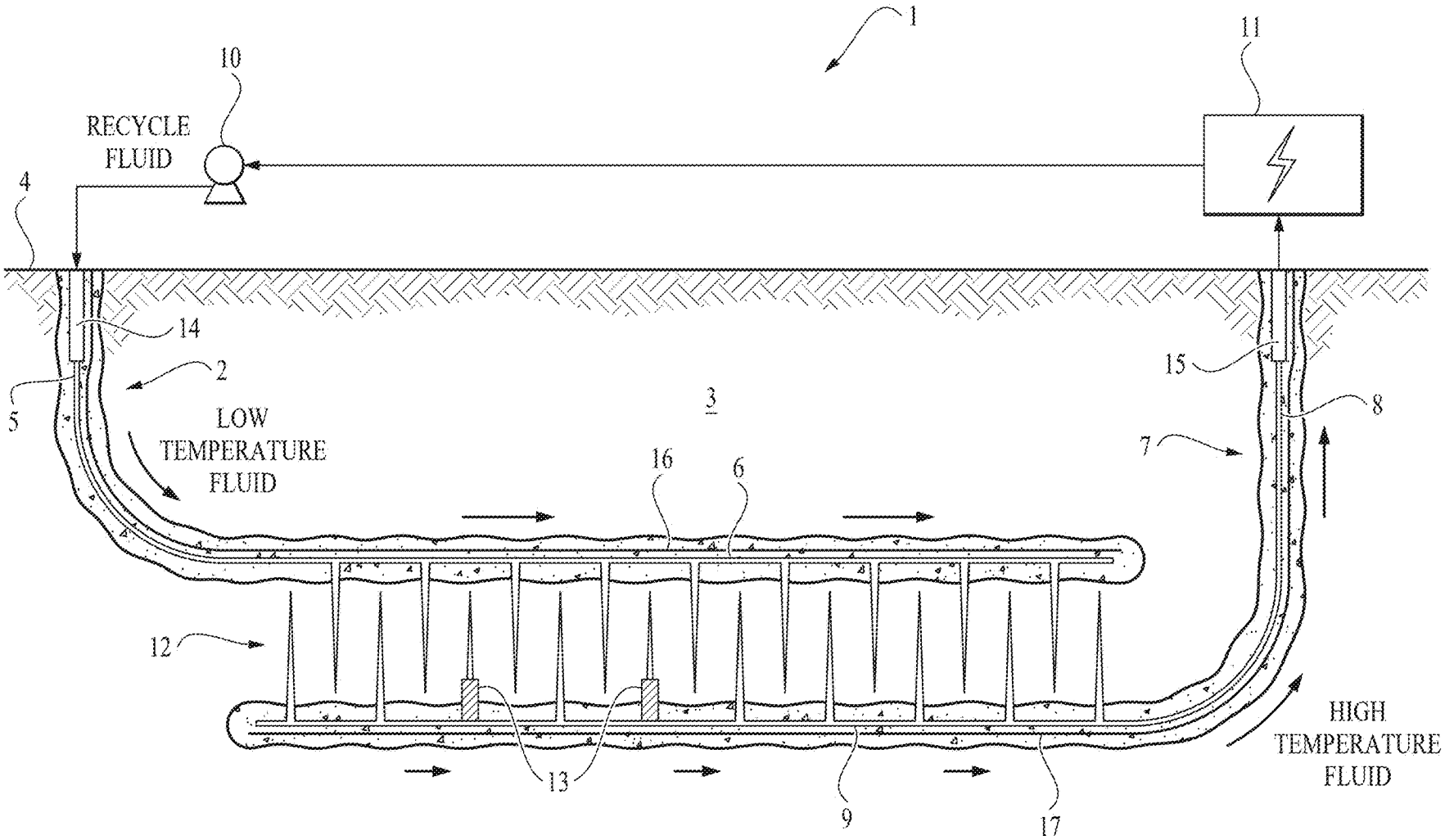
FIG. 2 is a schematic diagram of the geothermal well of FIG. 1 with sealant placed in the fractures.

Referring to FIG. 2, to improve efficiency of heat transfer from the formation 3 to the fluid being transferred from the injection wellbore 2 to the production wellbore 7 via the fractures or system of fractures 12, seals 13 may be added to one or more of the fractures within the system of fractures 12. Information may be gathered by a fiber optic cable 17 that may span along the production wellbore 7 (e.g., along the horizontal portion 9) and/or fiber optic cable 16 that may span along the injection wellbore 2 (e.g., along the horizontal portion 6). Whether to place the seals 13 and where to place the seals 13 may be determined by any of the methods disclosed herein. The method may include determining whether and/or where to add a seal 13 based on information from at least one fiber optic cable 16,17.

Figure 3:
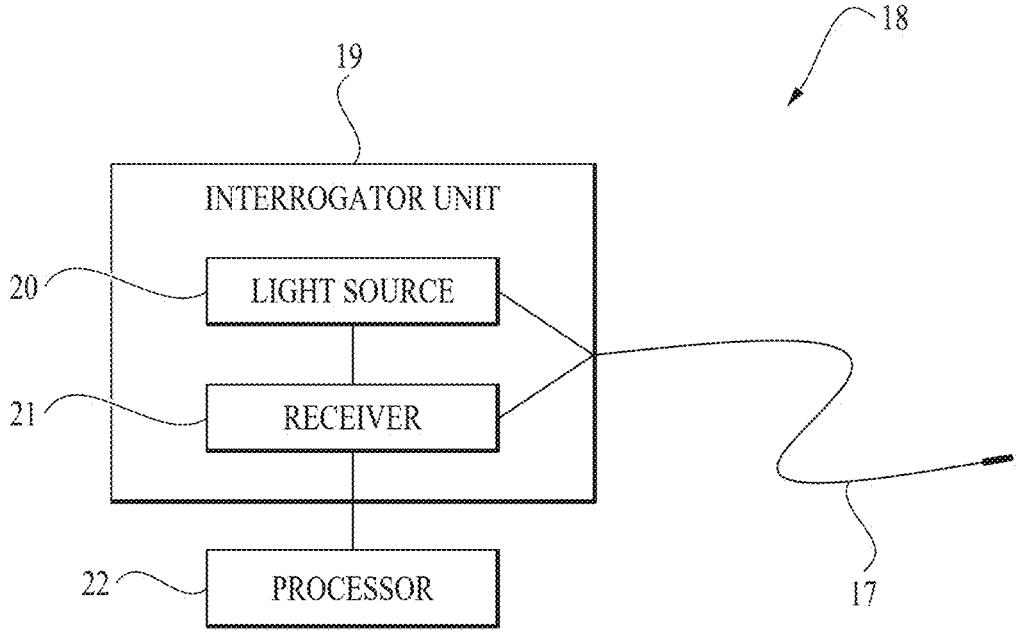
FIG. 3 is a schematic diagram of a DTS system, according to an embodiment.

FIG. 3 shows an exemplary DTS system 18. The DTS system 18 may be coupled to the fiber optic cable 17 (and/or to the fiber optic cable 16, see FIG. 1). The DTS system 18 may include an interrogator unit 19. The fiber optic cable 17 may be coupled to the interrogator unit 19. The interrogator unit 19 may comprise a light source 20 (e.g., a laser) that is configured to emit coherent light into the fiber optic cable 17, and a receiver 21 that is configured to receive backscattered light from the fiber optic cable 17. The interrogator unit 19 may be connected to a processor 22. The processor 22 may be a part of the DTS system 18 or it may be a separate processor disposed at a distance from the DTS system 18.

The processor 22 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. The processor 22 may include random access memory (RAM), one or more processing resources such as a central processing unit (CPU) or hardware or software control logic, ROM, and/or other types of nonvolatile memory. Additional components of the processor 22 may include one or more disk drives, one or more network ports for communication with external devices as well as an input device (e.g., keyboard, mouse, etc.), and video display. The processor 22 may also include one or more buses operable to transmit communications between the various hardware components.

Alternatively, systems and methods of the present disclosure may be implemented, at least in part, with non-transitory computer-readable media. The non-transitory computer-readable media may include any instrumentality or aggregation of instrumentalities that may retain data and/or instructions for a period of time. Non-transitory computer-readable media may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such as wires, optical fibers, microwaves, radio waves, and other electromagnetic and/or optical carriers; and/or any combination of the foregoing.

The fiber optic cable 17 may extend along a horizontal portion of the wellbore. The interrogator unit 19 may inject light pulses into the fiber optic cable 17, detect scattered light from the fiber optic cable, and generate a signal from the scattered light. The processor 22 (e.g., data acquisition system) may process the signal to generate the temperature distribution data. The method of determining where to inject the sealant may be based on the generated temperature distribution data.

Figure 4:
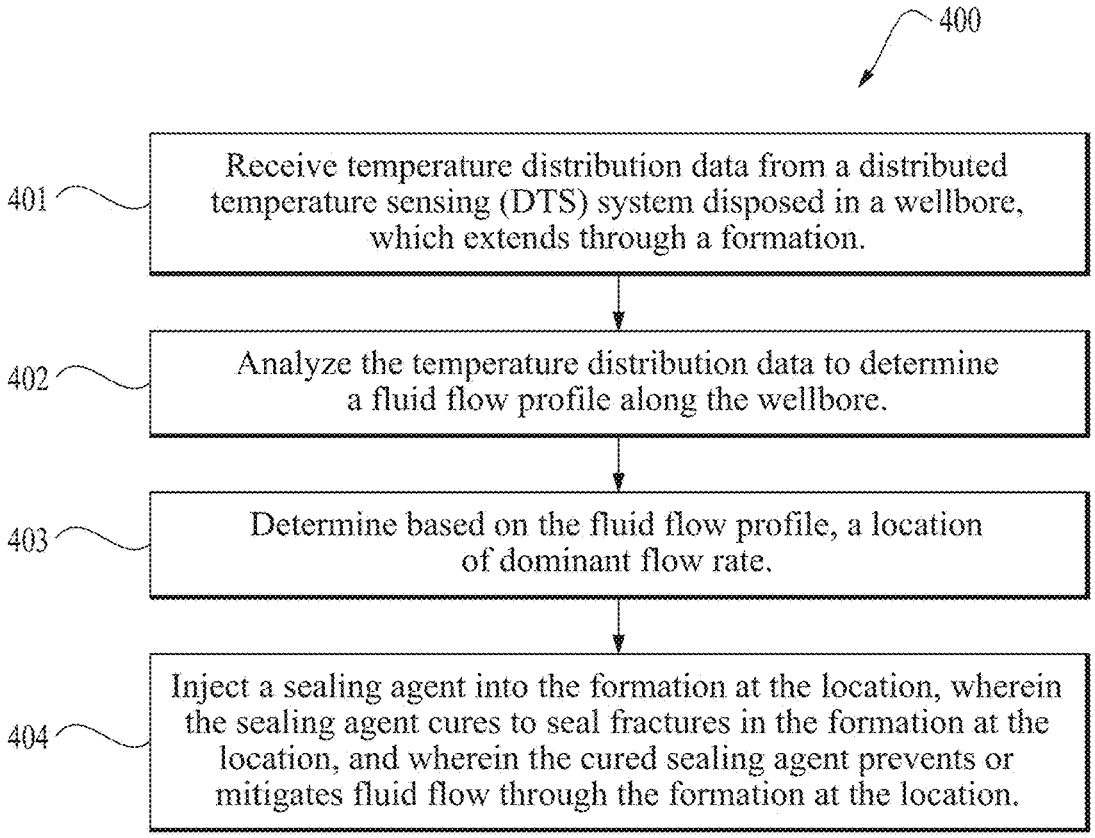
FIG. 4 is a flow diagram of a method of improving heat recovery from a geothermal well, according to an embodiment.

Referring to FIG. 4, a method 400 of improving heat recovery from a geothermal well may include the step 401 of receiving temperature distribution data from a DTS system disposed in a wellbore, which extends through a formation; the step 402 of analyzing the temperature distribution data to determine a fluid flow profile along the wellbore; the step 403 of determining, based on the fluid flow profile, a location of dominant flow rate; and/or the step 404 of injecting a sealing agent into the formation at the location, wherein the sealing agent cures to seal fractures within the system of fractures in the formation at the location, and/or wherein the cured sealing agent prevents or mitigates fluid flow through the formation at the location.

The DTS system may include a fiber optic cable extending along a horizontal portion of the wellbore; an interrogator unit configured to inject light pulses into the fiber optic cable, detect scattered light from the fiber optic cable, and generate a signal from the scattered light; and a processor (e.g., data acquisition system) configured to process the signal to generate the temperature distribution data. Analyzing the temperature distribution data may include inputting the temperature distribution data into a model to determine the fluid flow profile. Determining the location of the dominant flow rate may include identifying a local maximum flow rate based on a flow rate gradient of the fluid flow profile, and determining a location of the local maximum to be the location of the dominant flow rate. Injecting the sealing agent may include injecting the sealing agent through a coil tubing inserted into the wellbore. The sealing agent may include a brine, a furfuryl alcohol monomer, a particulate filler, an oil-wetting surfactant, and/or a silane coupling agent. The sealing agent may include an aqueous base fluid, an aluminosilicate, a metal silicate, and/or an alkali metal activator. The aluminosilicate may include metakaolin clay. The metal silicate may include sodium silicate. The alkali metal activator may include sodium hydroxide. The wellbore may be an injection wellbore or a production wellbore.

Figure 5:
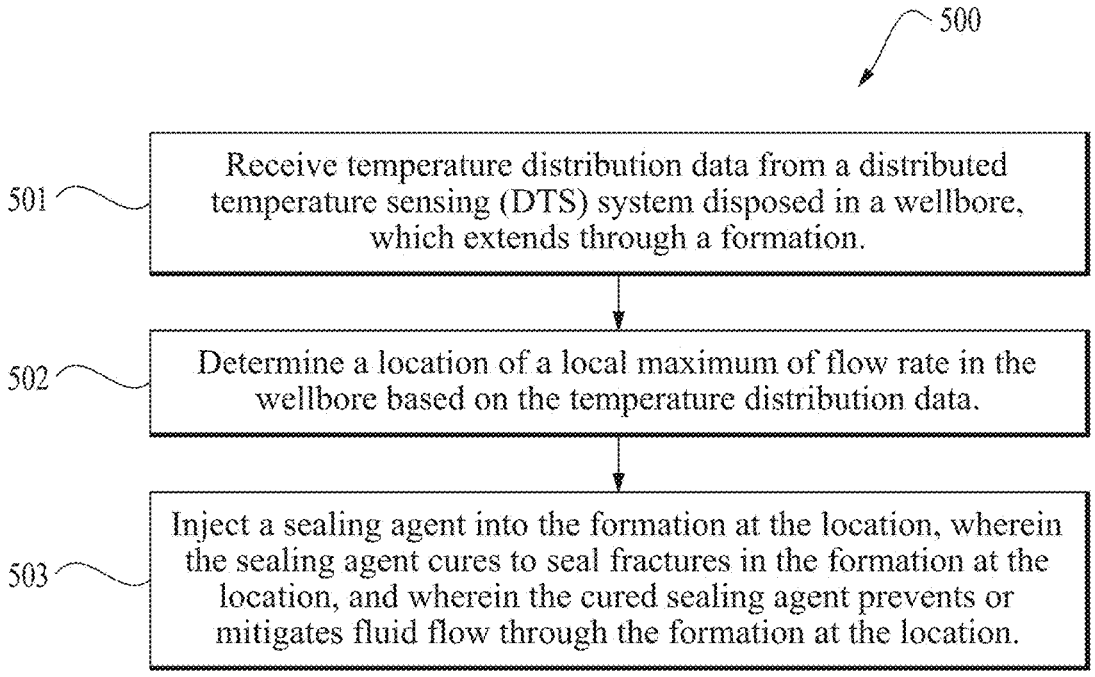
FIG. 5 is a flow diagram of a method of improving heat recovery from a geothermal well, according to another embodiment.

Referring to FIG. 5, a method 500 of improving heat recovery from a geothermal well may include the step 501 of receiving temperature distribution data from a DTS system disposed in a wellbore, which extends through a formation; the step 502 of determining a location of a local maximum of flow rate in the wellbore based on the temperature distribution data; and/or the step 503 injecting a sealing agent into the formation at the location, wherein the sealing agent cures to seal fractures within the system of fractures in the formation at the location, and/or wherein the cured sealing agent prevents or mitigates fluid flow through the formation at the location.

The wellbore may be an injection wellbore, in which case determining the location of the local maximum of flow rate may include determining a location of a local maximum of temperature gradient, and/or determining the location of the local maximum of temperature gradient to be the location of the local maximum of flow rate. The wellbore may be a production wellbore, in which case determining the location of the local maximum of flow rate may include determining a location of a local minimum of temperature, and/or determining the location of the local maximum of flow rate to be the location of the local minimum of temperature.

Figure 6:
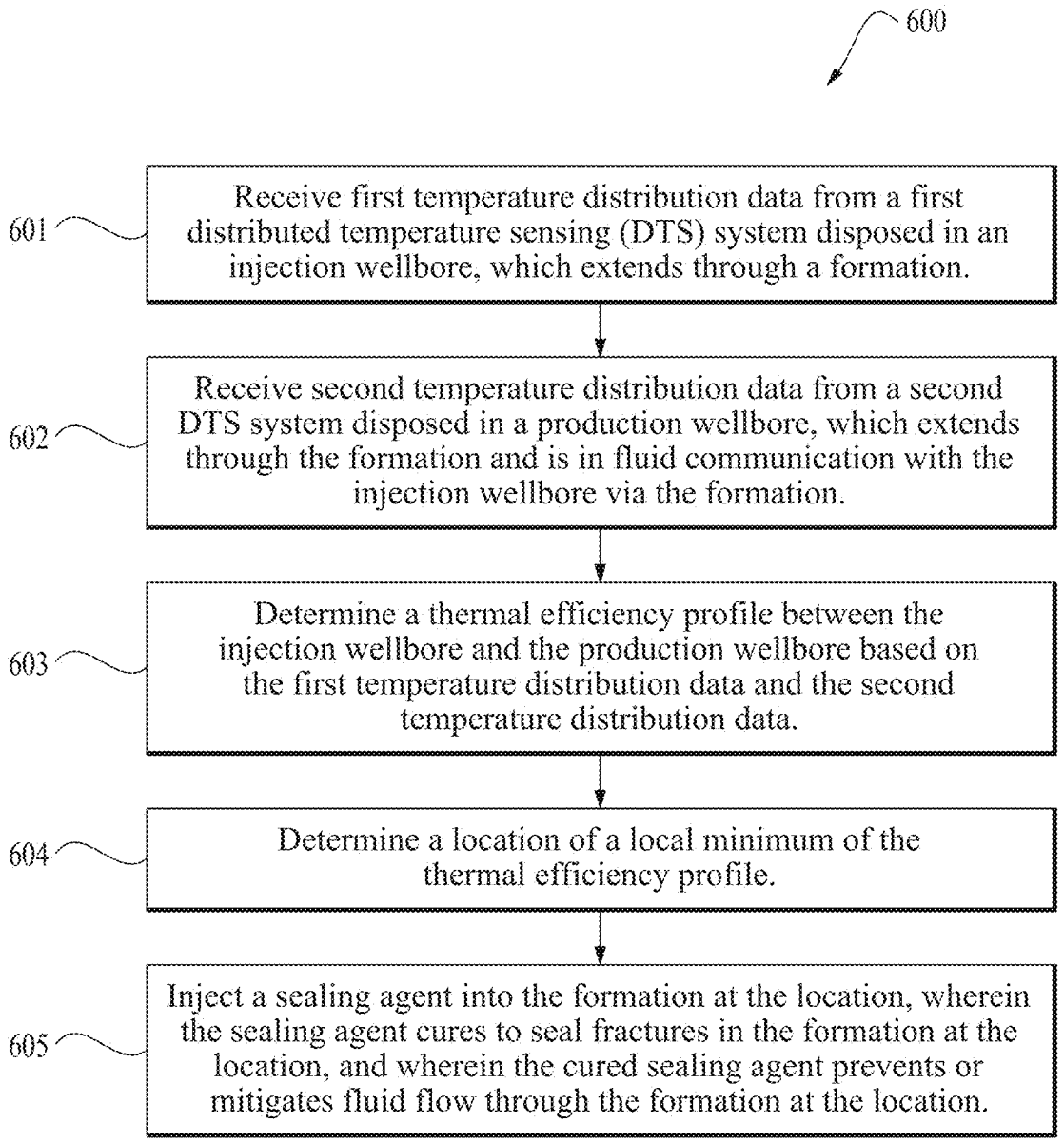
FIG. 6 is a flow diagram of a method of improving heat recovery from a geothermal well, according to yet another embodiment.

Referring to FIG. 6, a method 600 of improving heat recovery from a geothermal well may include the step 601 of receiving first temperature distribution data from a first DTS system disposed in an injection wellbore, which extends through a formation; the step 602 of receiving second temperature distribution data from a second DTS system disposed in a production wellbore, which extends through the formation and is in fluid communication with the injection wellbore via the formation; the step 603 of determining a thermal efficiency profile between the injection wellbore and the production wellbore based on the first temperature distribution data and the second temperature distribution data; the step 604 of determining a location of a local minimum of the thermal efficiency profile; and/or the step 605 of injecting a sealing agent into the formation at the location, wherein the sealing agent cures to seal fractures within the system of fractures in the formation at the location, and/or wherein the cured sealing agent prevents or mitigates fluid flow through the formation at the location.

Determining the thermal efficiency profile may include determining a set of temperature difference between points along the injection wellbore and points along the production wellbore. The set of temperature differences may be used to generate the thermal efficiency profile. The local minimum of the thermal efficiency profile may correspond to a local minimum of the set of temperature differences. The location of the local minimum of the thermal efficiency profile may correspond to a location of the local minimum of the set of temperatures. The injection wellbore may include a first horizontal section, the production wellbore may include a second horizontal section, the second horizontal section may be disposed deeper underground than the first horizontal section, and/or the first horizontal section may run parallel to the second horizontal section.

In certain embodiments of the present disclosure, the sealant may include a resin. The resin may be any resin that is capable of forming a hardened, consolidated mass. For example, the resin may include two-component epoxy-based resins, novolak resins, polyepoxide resins, phenol-aldehyde resins, urea-aldehyde resins, urethane resins, phenolic resins, furan resins, furan/furfuryl alcohol resins, phenolic/latex resins, phenol formaldehyde resins, polyester resins and hybrids and copolymers thereof, polyurethane resins and hybrids and copolymers thereof, acrylate resins, or mixtures thereof. Epoxy resins may be cured with an internal catalyst or activator so that when pumped downhole, they may be cured using only time and temperature. Furan resins may require a time-delayed catalyst or an external catalyst to help activate the polymerization of the resins if the cure temperature is low (i.e., less than 250° F.), but may cure under the effect of time and temperature if the formation temperature is above about 250° F., or in some cases above about 300° F.

The resin may include a resin composition with high thermal conductivity and/or a resin composition capable of withstanding high temperatures. The resin composition may undergo a polymerization reaction at high temperatures. Furfuryl alcohol resins and furan-based resins may be used, which may be stable at temperatures exceeding about 500° F. Some furfuryl alcohol resins and/or furan-based resins undergo a self-polymerization reaction at temperatures exceeding 275° F. The resin composition may provide consolidation strength for the wellbore, the formation, or the propped fractures therein. The resin composition may enhance the efficiency of heat transfer between the formation and the fluid in order to transform the fluid into steam or supercritical fluid. In certain embodiments, the resin may be chemically catalyzed with delayed internal catalysts. Alternatively, the resin may be chemically catalyzed via an acid in a post-drilling operation.

The sealant may include a geopolymer. The geopolymer may include an aluminosilicate source, a metal silicate source, and/or an activator. The geopolymer may be an inorganic polymer that forms long-range, covalently bonded, non-crystalline networks. The production of a geopolymer is known as geosynthesis, a reaction process that may involve naturally occurring aluminosilicates. The geopolymer may be formed by chemical dissolution and subsequent re-condensation of various aluminosilicates and silicates to form a 3D-network or three-dimensional mineral polymer. Geopolymers based on aluminosilicates may be designed as poly(silate), which is a shorter version of poly(silicon-oxo-aluminate). The silate network may comprise silicate and aluminate tetrahedrals linked alternately by sharing all oxygens, with $Al^{3+}$ and $Si^{4+}$ in IV-fold coordination with oxygen. A general geosynthesis reaction, which may not be representative of all geosynthesis reactions, is presented below in Equation 1. In Equation 1, aluminate, silicate, and metal hydroxide react to form the geopolymer.

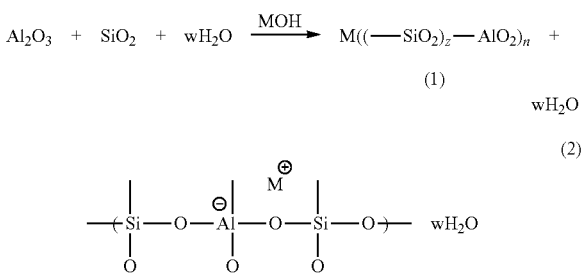

In Equation 1, the metal hydroxide, MOH, may comprise group 1 and 2 hydroxides. Some suitable hydroxides may include, but are not limited to, potassium hydroxide, sodium hydroxide, and calcium hydroxide. The degree of polymerization is denoted by n and the atomic ratio of Si to Al is denoted by z. The metal hydroxide may act as an activator for the geosynthesis reaction and as a stabilizing agent to the final polymer matrix. Equation 2 illustrates how the metal ion may act as a counter ion to counterbalance the negative charge of the aluminum metal. The geosynthesis reaction may be kinetically favored due to the presence of the counter anion. Other compounds may act as activators and may include, but are not limited to, chloride salts such as KCl, $CaCl_2$, NaCl, carbonates such as $Na_2CO_3$, silicates such as sodium silicate, aluminates such as sodium aluminate, and ammonium hydroxide. In general, the activators that do not comprise metal hydroxides may require an addition of hydroxide from another source to increase the rate of the reaction. In each case, the cation in the compound may also act as a counter anion. In some examples, a metal hydroxide and salt may be used together. In other examples, combinations of any salts, silicates, carbonates, aluminates, metal hydroxides, and ammonium hydroxide may be used. The activator may be dry mixed with the other geopolymer components to make the geopolymer composition. In other examples, the activator may be in an aqueous solution. The activator may be included in an amount in the range of from about 1% to about 20% by weight of the geopolymer composition. Some geopolymer compositions may have an activator included in amounts of about 1% to about 5%, about 5% to about 10%, about 10% to about 15%, about 15% to about 20%, or about 10% to about 20% by weight of the geopolymer composition.

The aluminosilicate source may comprise any suitable aluminosilicate. The aluminosilicate may be a mineral comprising aluminum, silicon, and oxygen, plus counter-cations. Some minerals such as andalusite, kyanite, and sillimanite are naturally occurring aluminosilicate sources. Each mineral andalusite, kyanite, or sillimanite may react more or less quickly and to different extents at the same temperature and pressure due to the differing crystal structures. The final geopolymer created from any one aluminosilicate may have both microscopic and macroscopic differences such as mechanical strength and thermal resistivity owing to the different aluminosilicate sources. Aluminosilicate may be a major component of kaolin and other clay minerals. Partially calcined clays such as kaolin may be an especially cost-effective and readily available aluminosilicate source. Other suitable aluminosilicate sources may include, but are not limited to, calcined clays, partially calcined clays, kaolinite clays, lateritic clays, illite clays, volcanic rocks, mine tailings, blast furnace slag, and coal fly ash. The aluminosilicate source may be present in an amount in the range of from about 1% to about 80% by weight of the geopolymer composition. Some geopolymer compositions may have the aluminosilicate source present in about 1% to about 10%, about 10% to about 20%, about 20% to about 30%, about 30%, to about 40%, about 40% to about 50%, about 50% to about 60%, about 60% to about 70%, about 70% to about 80%, or about 40% to about 80% by weight of the geopolymer composition.

The metal silicate source may comprise any suitable metal silicate. The silicate may be a compound containing an anionic silicon compound. The silicate may include the orthosilicate anion also known as silicon tetroxide anion, $SiO_4^{4-}$ as well as hexafluorosilicate $[SiF_6]^{2-}$. Other common silicates include cyclic and single chain silicates which may have the general formula $[SiO_{2+n}]^{2n-}$ and sheet-forming silicates $([SiO_{2.5}]^{-})_n$. Each silicate example may have one or more metal cations associated with each silicate molecule. Some suitable metal silicate sources and may include, without limitation, sodium silicate, magnesium silicate, and potassium silicate. The metal silicate source may be present in an amount in the range of from about 1% to about 80% by weight of the geopolymer cement composition. Some geopolymer compositions may have the metal silicate source present in about 1% to about 10%, about 10% to about 20%, about 20% to about 30%, about 30%, to about 40%, about 40% to about 50%, about 50% to about 60%, about 60% to about 70%, about 70% to about 80%, or about 40% to about 80% by weight of the geopolymer composition.

Figure 7:
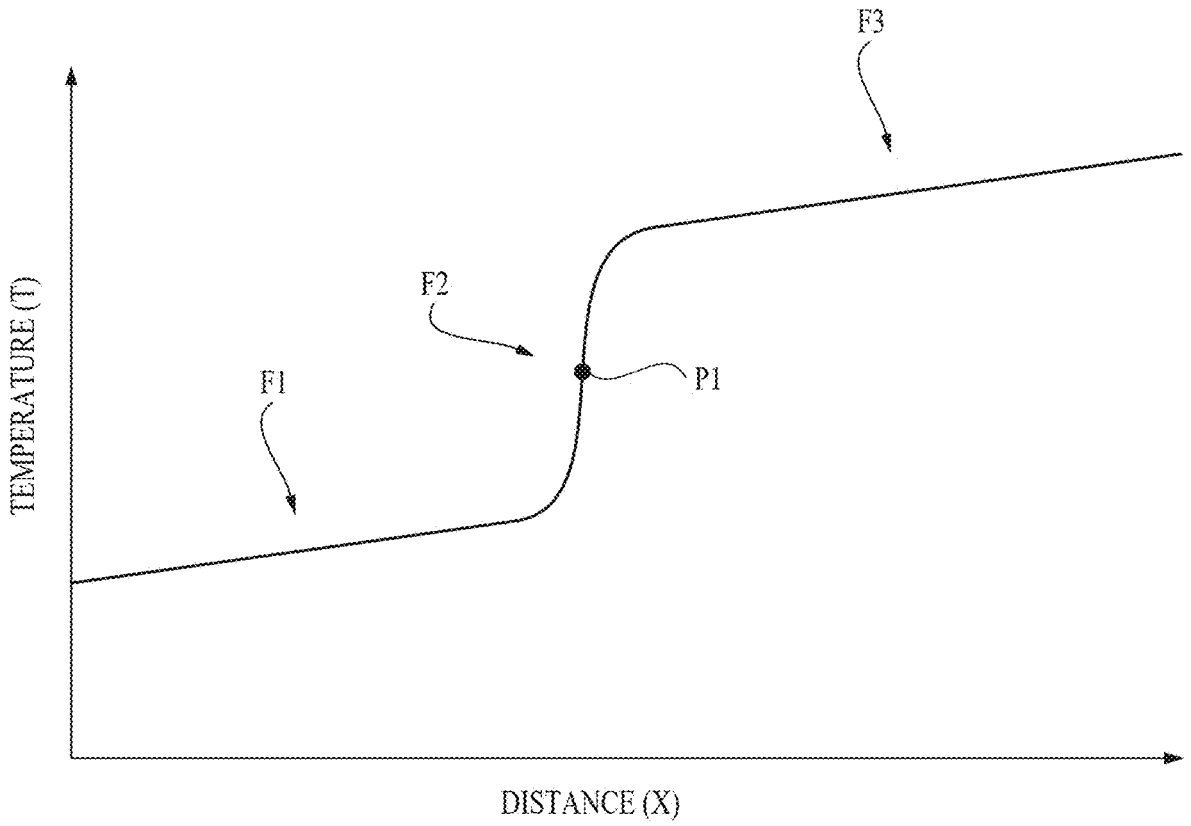
FIG. 7 is a graph of a temperature profile in the injection wellbore before a sealing operation, according to an embodiment.

FIGS. 7-10 depict an exemplary method of detecting a zone of high flow rate through the formation and plugging that zone. In particular, the method relates to detecting the zone of high flow rate via the fiber optic cable of the injection wellbore and plugging the zone via the injection wellbore. Referring to FIG. 7, a graph of temperature over distance is shown. The temperature may be the temperature detected by the DTS. The distance could be, for example, the distance from the heel to the toe of the horizonal portion of the injection wellbore, which may correspond to the physical position of at least a portion of the fiber optic cable. In this particular example, the graph has three features. Feature F1 is a gently upward sloping curve. As fluid is exposed to the hot geothermal formation, it heats up moving from heel to toe. Feature F2 is a portion of the graph that sharply slopes downward. Feature F3 is a gently upward sloping curve. The gradient of the temperature is high at feature F2. It is highest at point P1 (e.g., at point P1, $|dT/dX|$ is maximum). Thus, it may be determined (e.g., by a processor) that there is an excessive flow rate through the formation at point P1. In some embodiments, there may be multiple, local maximums of |dT/dX|. In those situations, it may be determined that there are excessive flow rates at those points. In some embodiments, it is determined that there is an excessive flow rate through the formation at point P1 in response to determining that the temperature gradient at P1 is below a threshold (e.g., by comparing P1 to the threshold). The threshold may be based on other gradients along the profile (e.g., an average gradient). In response to detecting that there is excessive flow rate at point P1, a decision may be made to deploy sealant to plug this zone (e.g., the zone at point P1). In response to detecting that there is excessive flow rate at multiple points, a decision may be made to deploy sealant to plug the formation at those multiple points.

Figure 8:
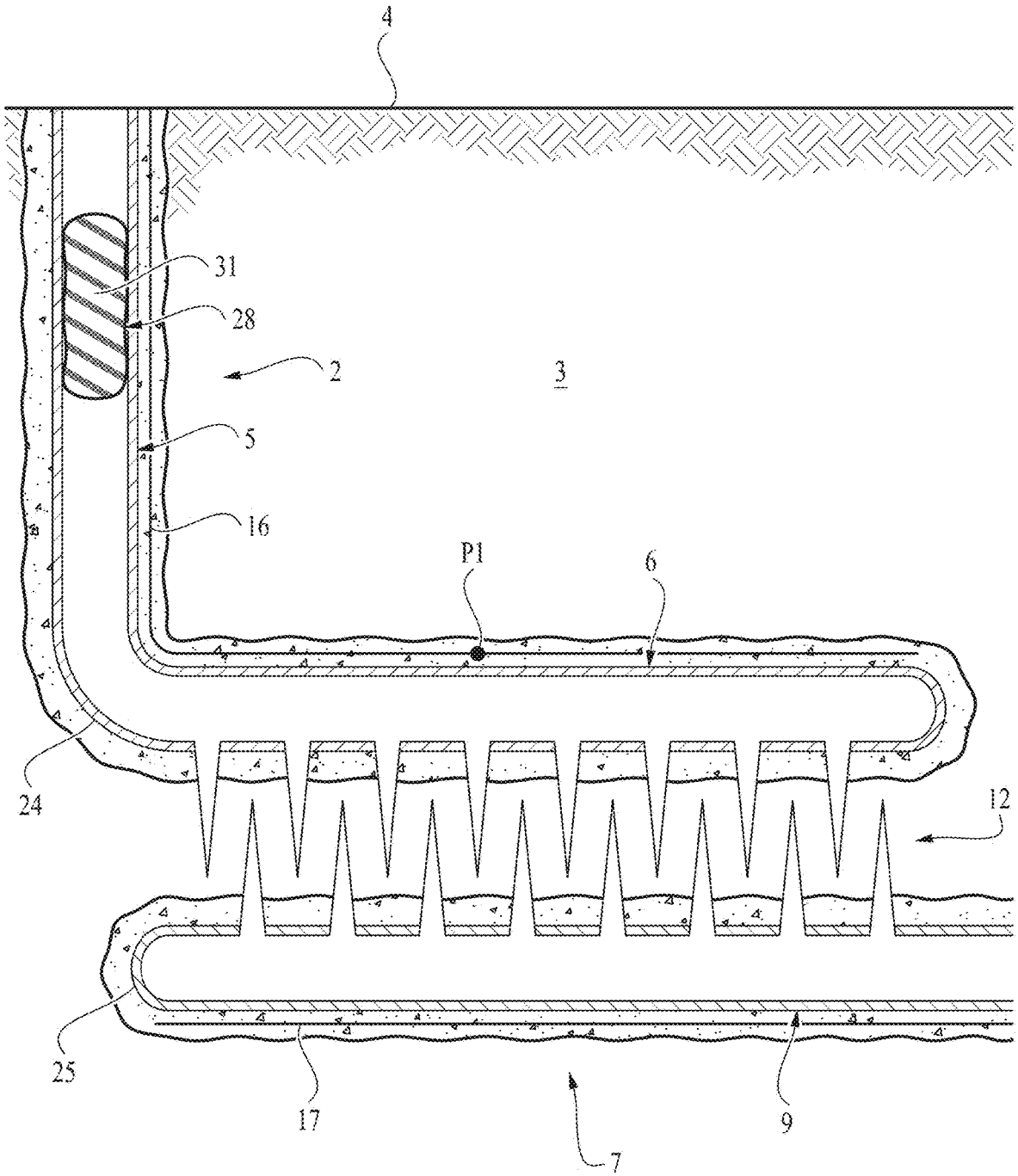
FIG. 8 is a schematic diagram of the injection wellbore during the sealing operation, according to an embodiment.
Figure 9:
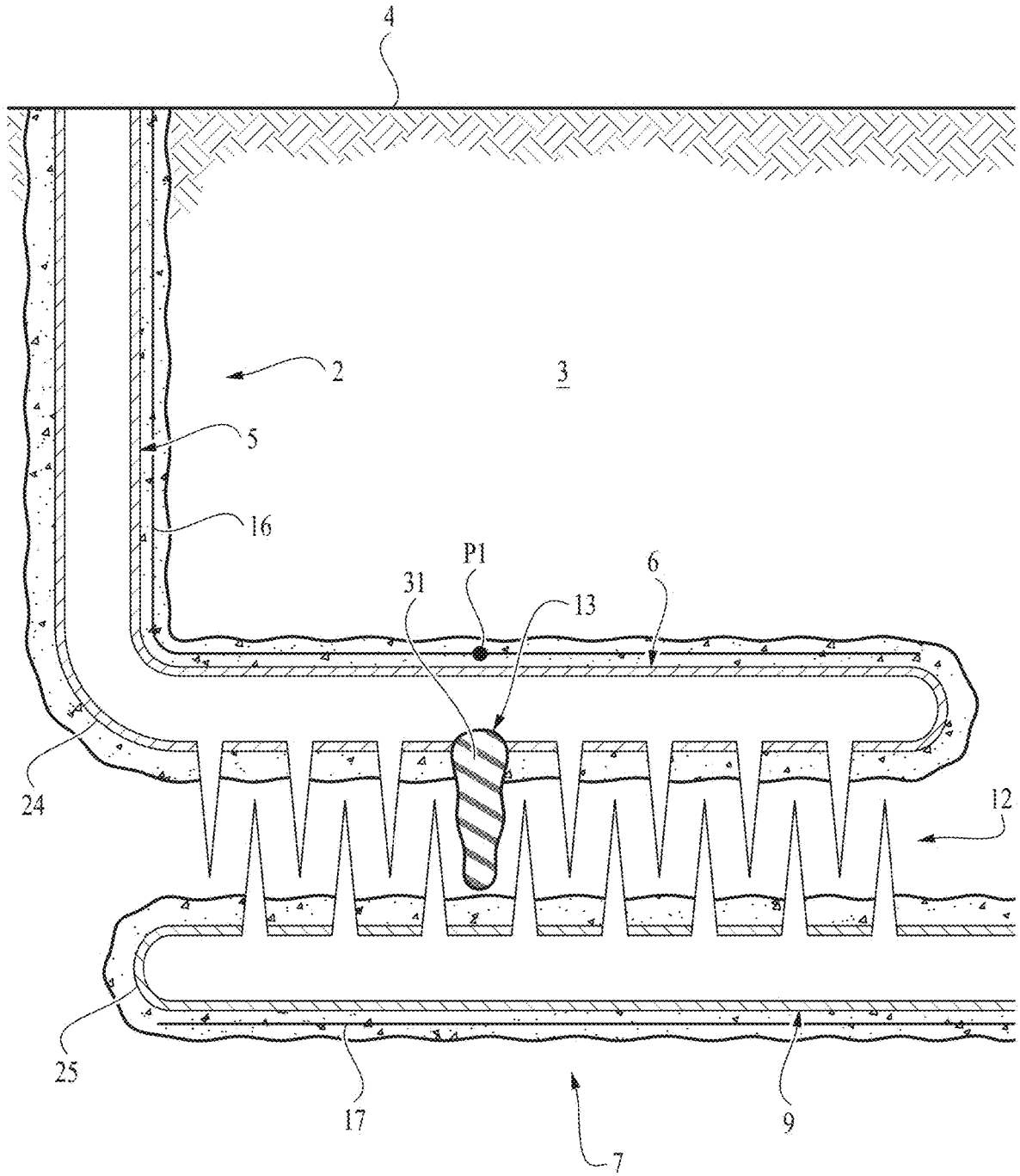
FIG. 9 is a schematic diagram of the injection wellbore after the sealing operation, according to an embodiment.

Referring to FIG. 8, the method may further include pumping a slug 28 of sealant 31 (e.g., furan-based resin and/or geopolymer) down the injection wellbore 2 (e.g., inside the casing 24). The flow of fluid inside the injection wellbore 2 may guide the slug to the point P1. Referring to FIG. 9, the sealant may enter the formation at the point P1. Injection may be paused to allow the sealant to cure there.

Figure 10:
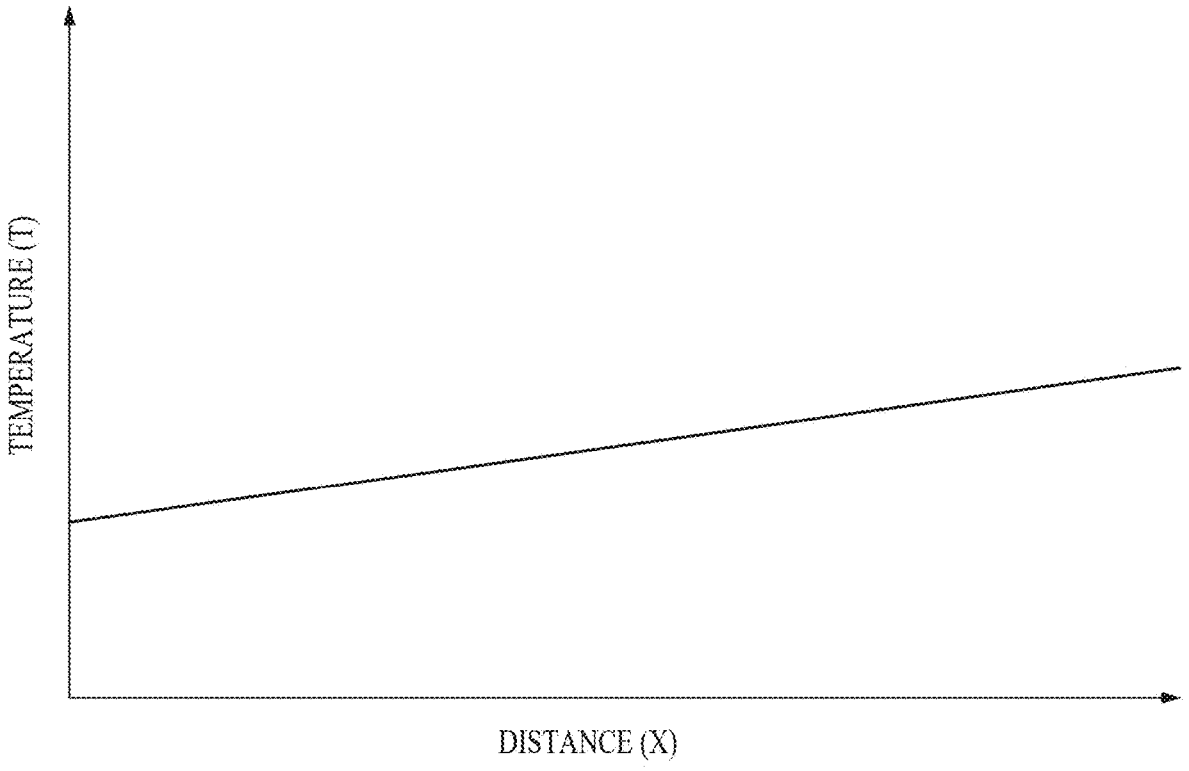
FIG. 10 is a graph of the temperature profile in the injection wellbore after the sealing operation, according to an embodiment.

FIG. 10 shows the temperature profile after the sealant has been placed. The method may include checking this temperature profile to confirm that the placement of the sealant was successful in stopping the excessive flow at the point P1. In this example, the graph shows that there is no high temperature gradient along the distance, and based on this, it may be determined that there is no zone of excessive flow. It may therefore be decided not to add more sealant. If, however, a high gradient is detected, the method may repeat until there is no longer a high gradient anywhere along the temperature profile. For example, the decision to place sealant may be based on whether there is a temperature gradient above a threshold. In response to there being a temperature gradient exceeding the threshold, a position of the temperature gradient exceeding the threshold may be determined, and a sealant may be deployed to that position. In response to there not being a temperature gradient exceeding the threshold, no sealant may be deployed.

Figure 11:
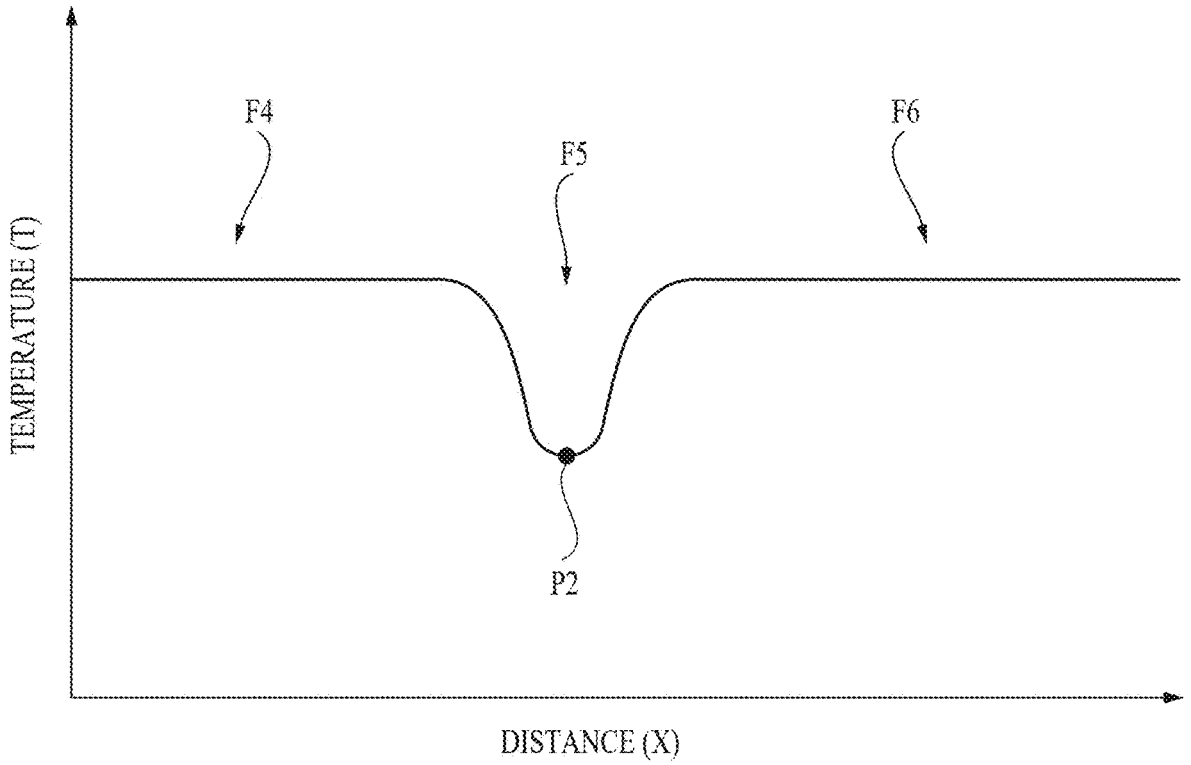
FIG. 11 is a graph of a temperature profile in the production wellbore before a sealing operation, according to an embodiment.

FIGS. 11-15, depict an exemplary method of detecting a zone of high flow rate through the formation and plugging that zone. In particular, it relates to detecting the zone of high flow rate via the fiber optic cable of the production wellbore and plugging the zone via the production wellbore. Referring to FIG. 11, a graph of temperature over distance is shown. The temperature may be the temperature detected by the DTS. The distance may be, for example, the distance from the heel to the toe of the horizonal portion of the production wellbore, which may correspond to the physical position of at least a portion of the fiber optic cable. In this particular example, the graph has three features. The feature F4 is a flat portion of the temperature profile. The feature F5 is a dip in the temperature profile. The feature F6 is a flat portion of the temperature profile. P2 is the lowest temperature of the temperature profile. Thus, it may be determined (e.g., by a processor) that there is an excessive flow rate through the formation at point P2. For example, it may be determined that there is an excessive flow rate through the formation at point P2 in response to determining that the temperature at P2 is less than a threshold. (e.g., by comparing P2 to the threshold). The threshold may be based on other temperatures along the profile (e.g., an average temperature). In some embodiments, there may be multiple local minimums of temperature T. In those situations, it may be determined that there are excessive flow rates at those points. In response to detecting that there is excessive flow rate at point P2, a decision may be made to deploy the sealant to plug this zone (e.g., the zone at point P2). In response to detecting that there is excessive flow rate at multiple points, a decision may be made to deploy sealant to plug the formation at those multiple points.

Figure 12:
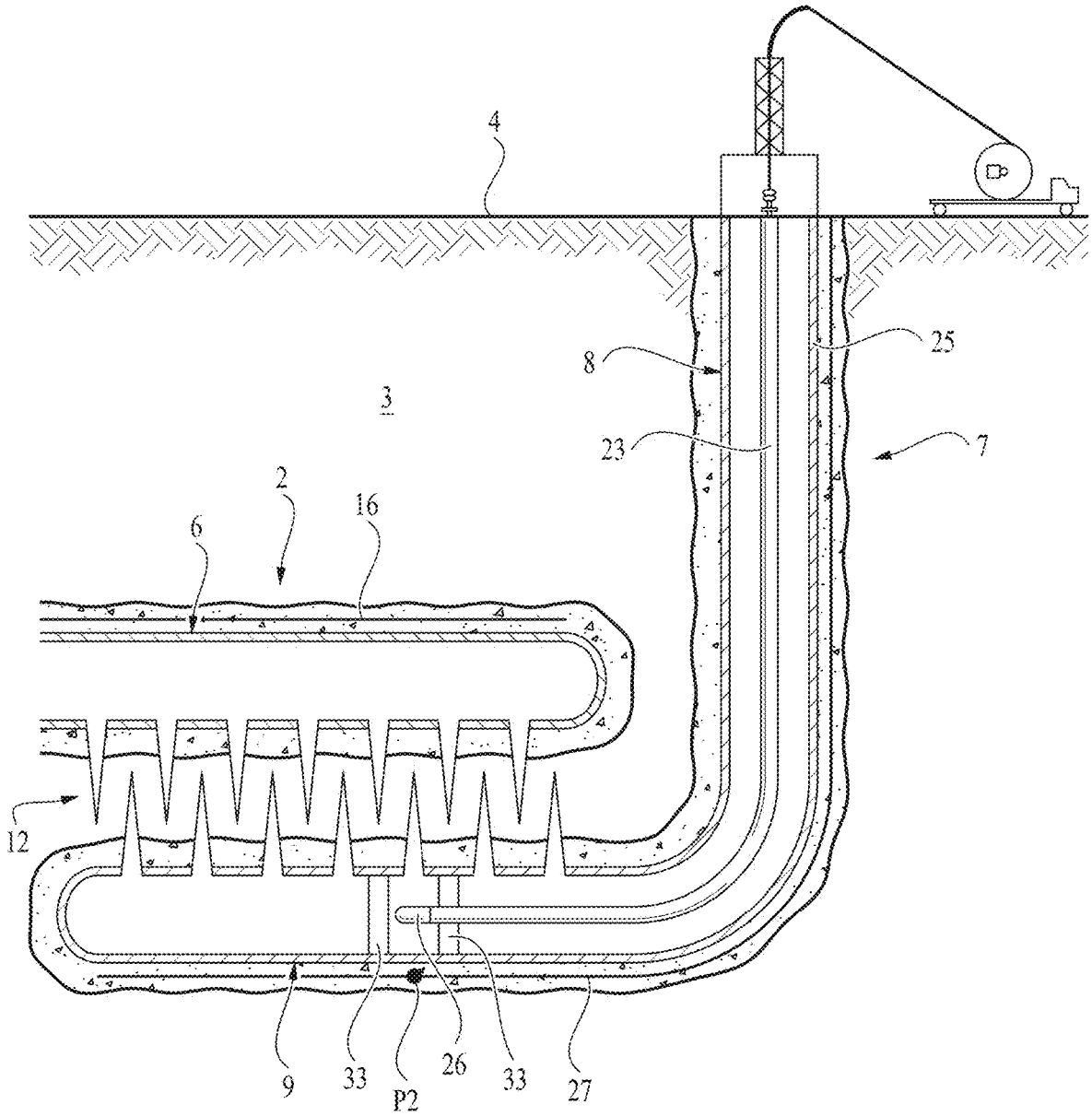
FIG. 12 is a schematic diagram of the production wellbore during the sealing operation, according to an embodiment.
Figure 13:
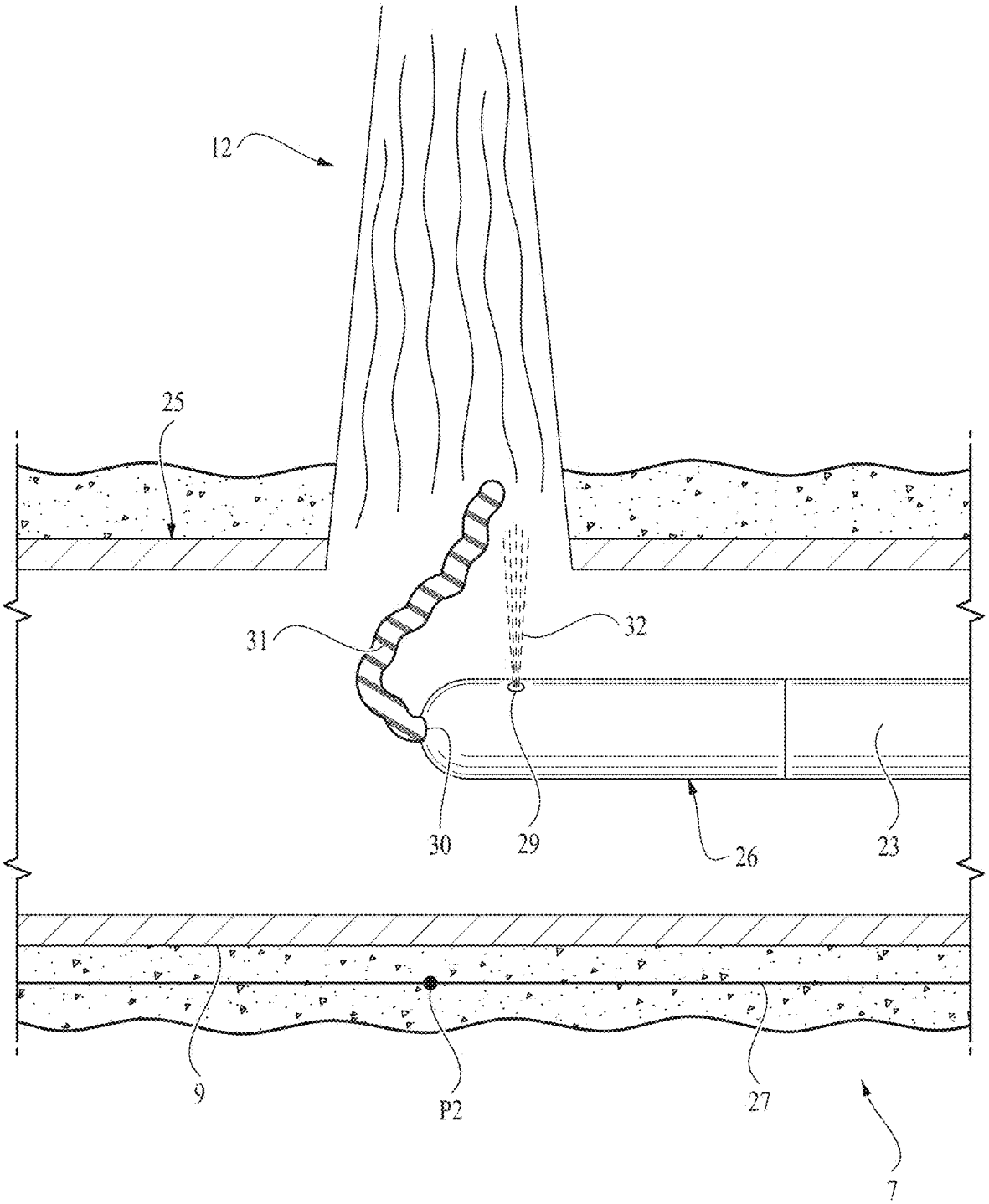
FIG. 13 is an enlarged schematic diagram of the production wellbore during the sealing operation, according to an embodiment.
Figure 14:
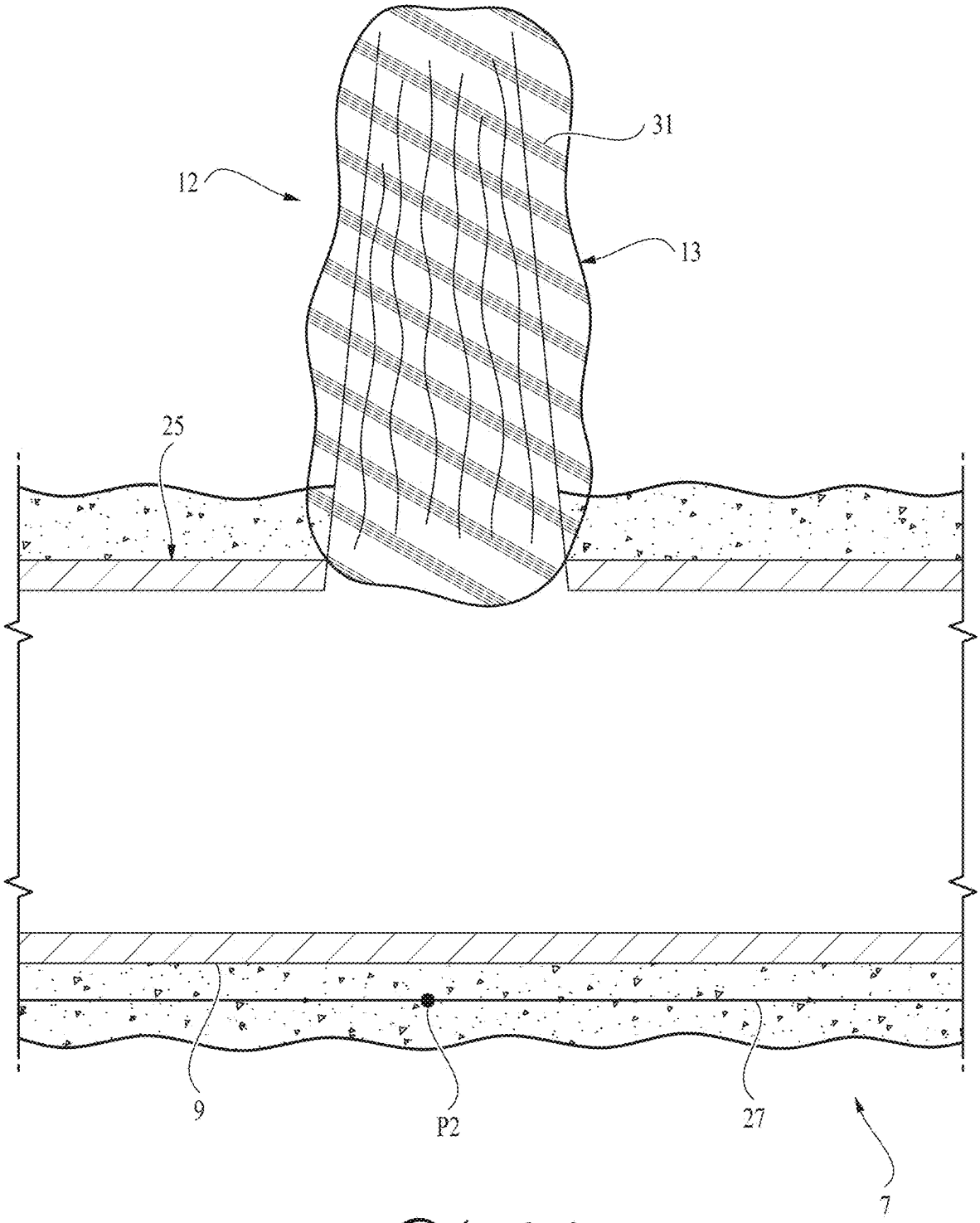
FIG. 14 is an enlarged schematic diagram of the production wellbore after the sealing operation, according to an embodiment.

Referring to FIG. 12, the method may further include running coil tubing 23 down the production wellbore 7 (e.g., inside the casing 25). On the coil tubing 23 (e.g., at the end of the coil tubing 23) there may be a seal placement device 26. Production may be paused for the sealing operation. Packers 33 may be disposed inside the horizontal portion 9 of the production wellbore 7 (e.g., to isolate fluid proximate to the point P2). In some embodiments, the packers 33 are attached to the coil tubing 23 and/or the seal placement device 26. Referring to FIG. 13, the seal placement device 26 may include a side jet 29 that may shoot a jet of fluid 32 (e.g., water) into the formation 3 at the location P2. Simultaneously, sealant 31 may be pumped out of a sealant outlet 30 of the seal placement device 26. The low pressure caused by the jet of fluid coming out of the side jet 29 may cause flow of the sealant 31 to that low-pressure zone, and thus the sealant 31 may make its way into the fracture system 12 at the location P2. As illustrated in FIG. 14, the sealant 31 may cure in the fracture system 12 at point P2.

Figure 15:
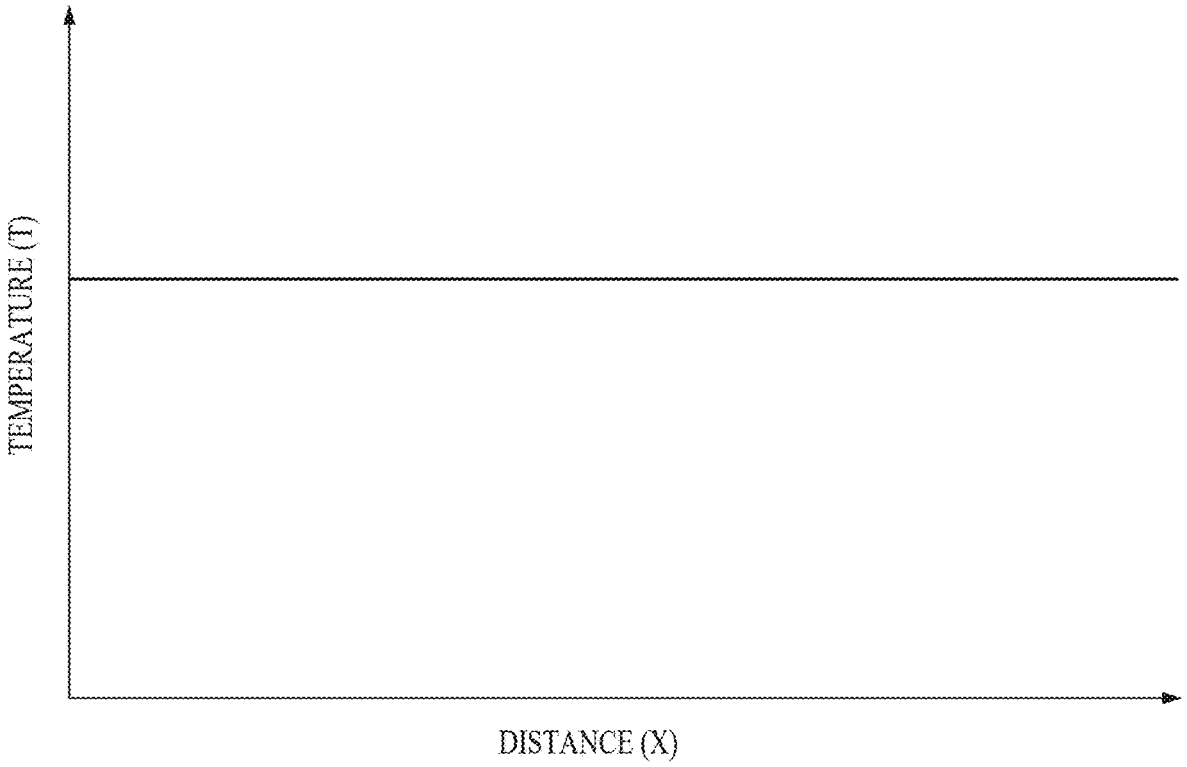
FIG. 15 is a graph of the temperature profile in the production wellbore after the sealing operation, according to an embodiment.
Figure 10:
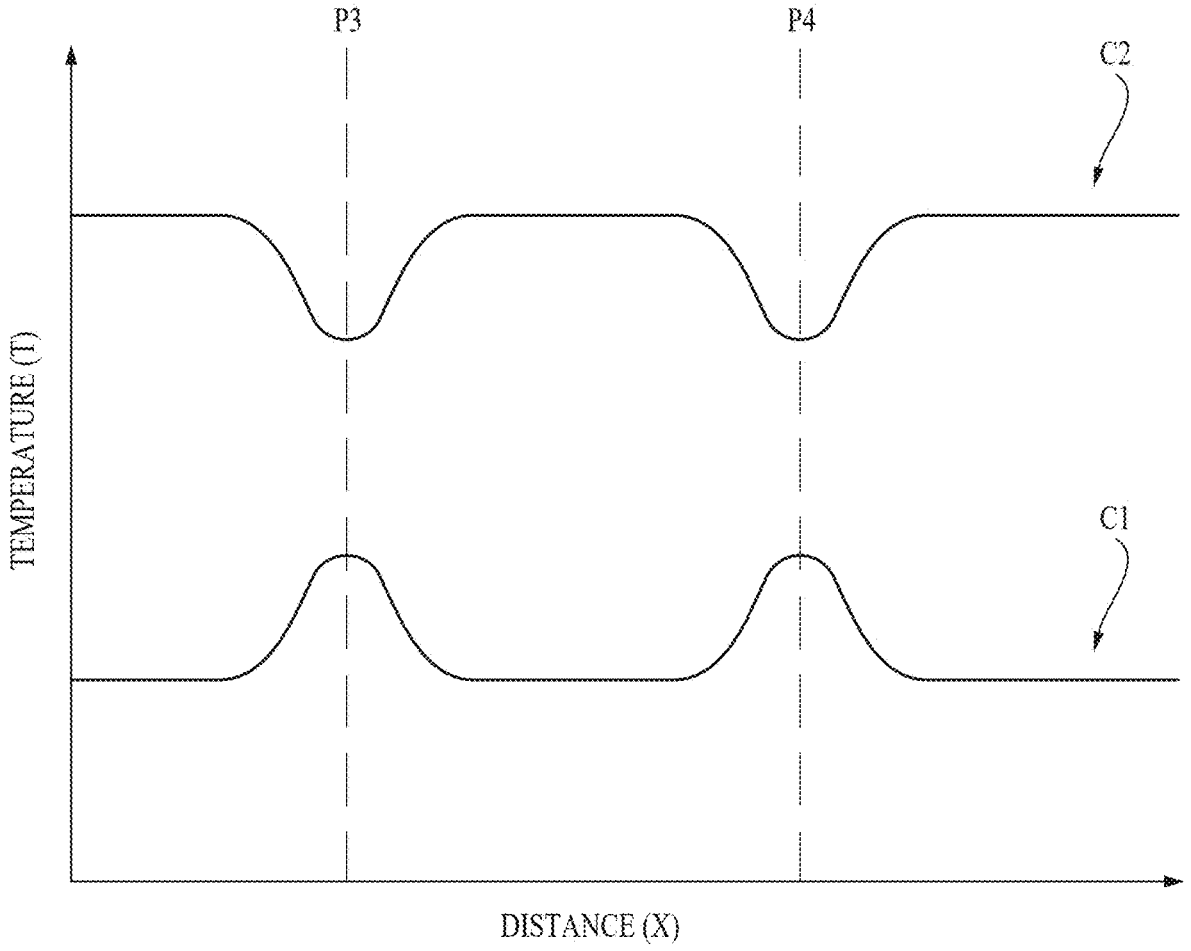

FIG. 15 shows the temperature profile after the sealant has been placed. The method may include checking this temperature profile to confirm that the placement of the sealant was successful in stopping the excessive flow (e.g., at the point P2). In this example, the graph shows that there is no low temperature along the distance, and based on this, it may be determined that there is no zone of excessive flow. It may therefore be decided not to add more sealant. If, however, a low temperature is detected, the method may repeat until there is no longer a low temperature anywhere along the temperature profile. For example, the decision to place sealant may be based on whether there is any temperature along the profile that is lower than a temperature threshold. In response to there being a temperature less than the threshold, a position of the temperature being below the threshold may be determined, and sealant may be deployed to that position. In response to there not being a temperature less than the threshold, no sealant may be deployed.

Figure 17:
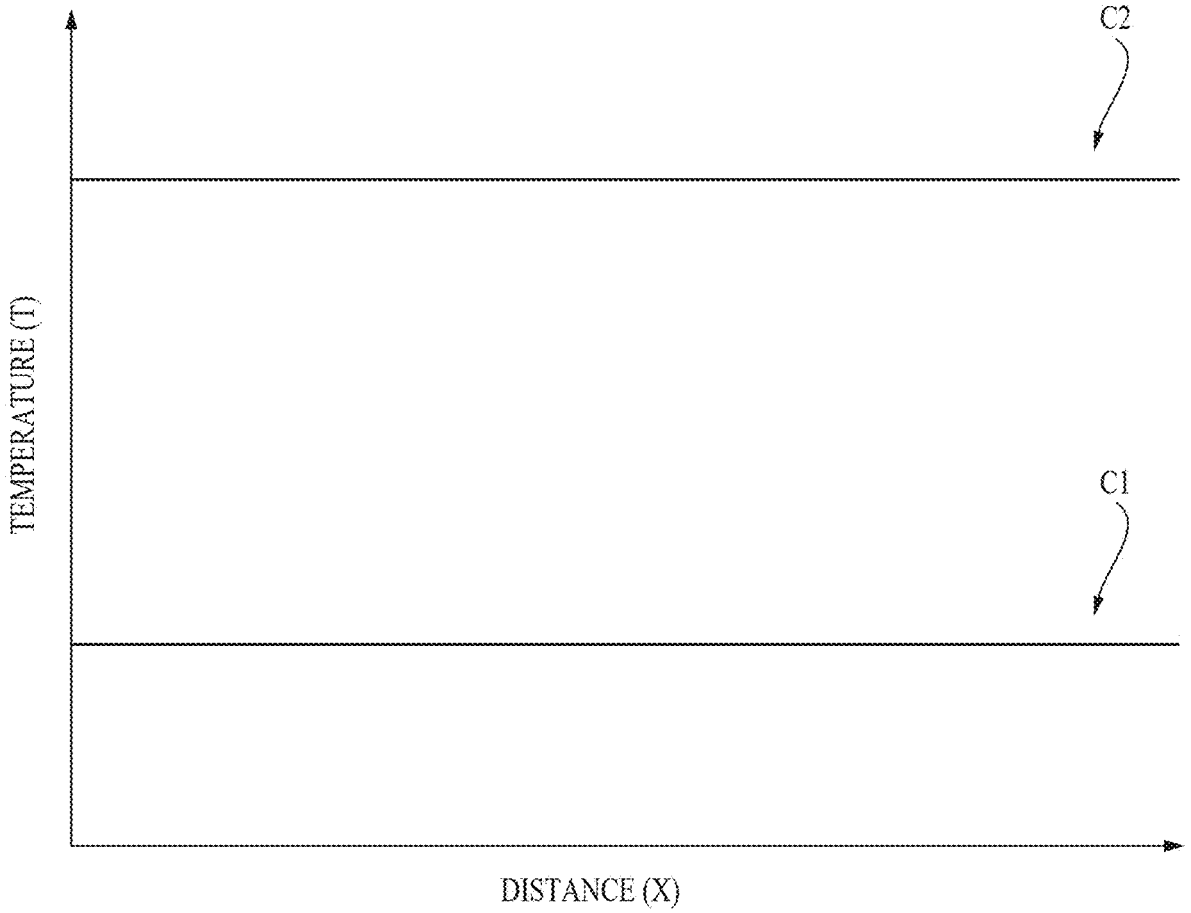
FIG. 17 is a graph of the temperature profile in the injection wellbore and the temperature profile in the production wellbore after the sealing operation, according to an embodiment.

Referring to FIGS. 16-17, a method of adjusting flow through a formation based on a temperature profile of the injection well and a temperature profile of a production well is illustrated. FIG. 16 shows a temperature profile C1 of the injection well (e.g., detected by a DTS installed in the injection well) and a temperature profile C2 of a production well (e.g., detected by a DTS installed in a production well). The distance may be a horizontal distance common to the horizonal portion of the injection well and the horizontal portion of the production well. The method may include determining the location of relative minimum of a temperature difference between the temperature profile C2 production well and the temperature profile C1 of the injection well. This temperature difference may be referred to as a thermal efficiency profile. In this example, there are local minimums of the difference are at points P3 and P4. The method may determine whether the temperature difference is less than a threshold. The threshold may be based on temperature differences across the two profiles (e.g., an average temperature difference across the two profiles). In response to detecting that the temperature difference is less than the threshold, the method may include placing a sealant at points P3 and P4. The method may include gathering new data after the sealing and repeating the analysis to determine if there are any relative minimum differences in temperature between the temperature profile C2 of the production well and the temperature profile C1 of the injection well. In the particular example shown in FIG. 17, there are none, and thus no additional sealants are placed. If, however, a relative minimum of the difference is detected, and it is determined that relative minimum is less than a threshold, then a decision may be made to place an additional sealant at a location corresponding to the relative minimum.

The applications of the DTS described herein may help map the effectiveness of fracturing by identifying zones with significant temperature changes, which may be used to determine fluid flow paths within the rock. The ability to optimize fluid injection and production based on real-time temperature data may lead to increased efficiency in heat extraction from the reservoir, thus maximizing energy production. By monitoring temperature profiles during fluid injection and extraction, operators can determine how efficiently the injected fluid is heating up and where the hottest geothermal fluids are located within the fractured rock zones. Sealing with furan-based resins and/or geopolymers may provide an economical means for water shut-off.

System and method according to the present disclosure may present the advantage of allowing real-time monitoring of temperature changes along the length of the wellbore. Flow profiling may be enabled by detecting changes in temperature along the wellbore caused by fluid movement. The system and method may provide continuous temperature monitoring along the wellbore and within the reservoir. This may allow operators to track temperature changes over time, which may lead to an understanding reservoir behavior. Areas of heat transfer may be identified. By optimizing flow rates and distribution by injecting a furan-based resin and/or a geopolymer into the wellbore, the geothermal fluids may be efficiently swept across the entire reservoir section, including areas with propped fractures, thus maximizing contact with hot rock formations and maximizing energy extraction. The furan-based resins and/or geopolymers may be able to withstand high temperatures of geothermal wells, thus effectively controlling the flow within the geothermal well for improved efficiency of the geothermal power plant.

ADDITIONAL DISCLOSURE

The following are non-limiting, specific embodiments in accordance with the present disclosure:

In a first embodiment, a method of improving heat recovery from a geothermal well comprises receiving temperature distribution data from a distributed temperature sensing (DTS) system comprising a fiber optic cable disposed in a wellbore, which extends through a formation; analyzing the temperature distribution data to determine a fluid flow profile along the wellbore; determining, based on the fluid flow profile, a location of dominant flow rate; and injecting a sealing agent into the formation at the location, wherein the sealing agent cures to seal fractures within the fracture system in the formation at the location, and wherein the cured sealing agent prevents or mitigates fluid flow through the formation at the location.

A second embodiment can include the method of the first embodiment, wherein the DTS system comprises an interrogator unit configured to inject light pulses into the fiber optic cable, detect scattered light from the fiber optic cable, and generate a signal from the scattered light; and a processor (e.g., data acquisition system) configured to process the signal to generate the temperature distribution data.

A third embodiment can include the method of the first or second embodiments, wherein the analyzing of the temperature distribution data comprises inputting the temperature distribution data into a model to determine the fluid flow profile.

A fourth embodiment can include the method of any of the first through third embodiments, wherein the determining of the location of the dominant flow rate comprises identifying a local maximum flow rate based on a flow rate gradient of the fluid flow profile, and determining a location of the local maximum to be the location of the dominant flow rate.

A fifth embodiment can include the method of any of the first through fourth embodiments, wherein the injecting of the sealing agent comprises injecting the sealing agent through a coil tubing inserted into the wellbore.

A sixth embodiment can include the method of any of the first through fifth embodiments, wherein the sealing agent comprises a brine, a furfuryl alcohol monomer, a particulate filler, an oil-wetting surfactant, and a silane coupling agent.

A seventh embodiment can include the method of any of the first through sixth embodiments, wherein the sealing agent comprises an aqueous base fluid, an aluminosilicate, a metal silicate, and an alkali metal activator.

An eighth embodiment can include the method of any of the first through seventh embodiments, wherein the aluminosilicate comprises metakaolin clay.

A ninth embodiment can include the method of any of the first through eighth embodiments, wherein the metal silicate comprises sodium silicate.

A tenth embodiment can include the method of any of the first through ninth embodiments, wherein the alkali metal activator comprises sodium hydroxide.

An eleventh embodiment can include the method of any of the first through tenth embodiments, wherein the wellbore is an injection wellbore.

A twelfth embodiment can include the method of any of the first through eleventh embodiments, wherein the wellbore is a production wellbore.

In a thirteenth embodiment, a method of improving heat recovery from a geothermal well comprises receiving temperature distribution data from a distributed temperature sensing (DTS) system comprising a fiber optic cable disposed in a wellbore, which extends through a formation; determining a location of a local maximum of flow rate in the wellbore based on the temperature distribution data; and injecting a sealing agent into the formation at the location, wherein the sealing agent cures to seal fractures within the fracture system in the formation at the location, and wherein the cured sealing agent prevents or mitigates fluid flow through the formation at the location.

A fourteenth embodiment can include the method of the thirteenth embodiments, wherein the wellbore is an injection wellbore, and the determining of the location of the local maximum of flow rate comprises determining a location of a local maximum of temperature gradient, and determining the location of the local maximum of temperature gradient to be the location of the local maximum of flow rate.

A fifteenth embodiment can include the method of the thirteenth or fourteenth embodiments, wherein the wellbore is a production wellbore, and the determining of the location of the local maximum of flow rate comprises determining a location of a local minimum of temperature, and determining the location of the local maximum of flow rate to be the location of the local minimum of temperature.

In a sixteenth embodiment, a method of improving heat recovery from a geothermal well comprises receiving first temperature distribution data from a first distributed temperature sensing (DTS) system comprising a first fiber optic cable disposed in an injection wellbore, which extends through a formation; receiving second temperature distribution data from a second DTS system comprising a second fiber optic cable disposed in a production wellbore, which extends through the formation and is in fluid communication with the injection wellbore via the formation; determining a thermal efficiency profile between the injection wellbore and the production wellbore based on the first temperature distribution data and the second temperature distribution data; determining a location of a local minimum of the thermal efficiency profile; and injecting a sealing agent into the formation at the location, wherein the sealing agent cures to seal fractures within the fracture system in the formation at the location, and wherein the cured sealing agent prevents or mitigates fluid flow through the formation at the location.

A seventeenth embodiment can include the method of the sixteenth embodiment, wherein the determining of the thermal efficiency profile comprises determining a set of temperature difference between points along the injection wellbore and points along the production wellbore, and wherein the set of temperature differences are used to generate the thermal efficiency profile.

An eighteenth embodiment can include the method of the sixteenth or seventeenth embodiments, wherein the local minimum of the thermal efficiency profile corresponds to a local minimum of the set of temperature differences.

A nineteenth embodiment can include the method of any of the sixteenth through eighteenth embodiments, wherein the location of the local minimum of the thermal efficiency profile corresponds to a location of the local minimum of the set of temperatures.

A twentieth embodiment can include the method of any of the sixteenth through nineteenth embodiments, wherein the injection wellbore comprises a first horizontal section, the production wellbore comprises a second horizontal section, the second horizontal section is disposed deeper underground than the first horizontal section, and the first horizontal section runs parallel to the second horizontal section.

While embodiments have been shown and described, modifications thereof can be made by one skilled in the art without departing from the spirit and teachings of this disclosure. The embodiments described herein are exemplary only and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, R1, and an upper limit, Ru, is disclosed, any number falling within the range is specifically disclosed. In particular, the following numbers within the range are specifically disclosed: $R=R1+k*(Ru-R1)$, wherein k is a variable ranging from 1 percent to 100 percent with a 1 percent increment, i.e., k is 1 percent, 2 percent, 3 percent, 4 percent, 5 percent, 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Disclosure of a singular element should be understood to provide support for a plurality of the element. It is contemplated that elements of the present disclosure may be duplicated in any suitable quantity.

Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded. The use of the terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" does not require selection of only one element. Thus, the phrase "A or B" is satisfied by either one or both elements from the set {A, B}, including multiples of either element; and the phrase "A, B, or C" is satisfied by any element from the set {A, B, C} or any combination thereof, including multiples of any element. A clause that recites "A, B, or C" can be infringed with only one of the listed items, multiple of the listed items, and one or more of the items in the list and another item not listed.

As used herein, the article "a" means "one or more." As used herein, the article "an" means "one or more." As used herein, the article "the" when referring to a singular noun means "the one or more." Thus, the phrase "an element" means "one or more elements;" and the phrase "the element" means "the one or more elements."

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

What is claimed is:

1. A method of improving heat recovery from a geothermal well, comprising:

receiving temperature distribution data from a distributed temperature sensing (DTS) system comprising a fiber optic cable disposed in a wellbore, which extends through a formation;

analyzing the temperature distribution data to determine a fluid flow profile along the wellbore;

determining, based on the fluid flow profile, a location of dominant flow rate, wherein the determining of the location of the dominant flow rate comprises identifying a local maximum flow rate based on a flow rate gradient of the fluid flow profile, and determining the location of dominant flow rate to be a location of the local maximum; and injecting a sealing agent into the formation at the location, wherein the sealing agent cures to seal fractures within a fracture system in the formation at the location, and wherein the cured sealing agent prevents or mitigates fluid flow through the formation at the location.

2. The method of claim 1, wherein the DTS system further comprises:

an interrogator unit configured to inject light pulses into the fiber optic cable, detect scattered light from the fiber optic cable, and generate a signal from the scattered light; and a processor configured to process the signal to generate the temperature distribution data.

3. The method of claim 1, wherein the analyzing of the temperature distribution data comprises inputting the temperature distribution data into a model to determine the fluid flow profile.

4. The method of claim 1, wherein the injecting of the sealing agent comprises injecting the sealing agent through a coil coiled tubing inserted into the wellbore.

5. The method of claim 1, wherein the sealing agent comprises a brine, a furfuryl alcohol monomer, an oil-wetting surfactant, and a silane coupling agent.

6. The method of claim 5, wherein the sealing agent further comprises a particulate filler.

7. The method of claim 1, wherein the sealing agent comprises an aqueous base fluid, an aluminosilicate, a metal silicate, and an alkali metal activator.

8. The method of claim 7, wherein the aluminosilicate comprises metakaolin clay.

9. The method of claim 7, wherein the metal silicate comprises sodium silicate.

10. The method of claim 7, wherein the alkali metal activator comprises sodium hydroxide.

11. The method of claim 1, wherein the wellbore is an injection wellbore.

12. The method of claim 1, wherein the wellbore is a production wellbore.

13. A method of improving heat recovery from a geothermal well, comprising:

receiving temperature distribution data from a distributed temperature sensing (DTS) system comprising a fiber optic cable disposed in an injection wellbore, which extends through a formation;

determining a location of a local maximum of flow rate in the injection wellbore based on the temperature distribution data, wherein the determining of the location of the local maximum of flow rate comprises determining a location of a local maximum of temperature gradient, and determining the location of the local maximum of temperature gradient to be the location of the local maximum of flow rate; and injecting a sealing agent into the formation at the location, wherein the sealing agent cures to seal fractures within a fracture system in the formation at the location, and wherein the cured sealing agent prevents or mitigates fluid flow through the formation at the location.

14. A method of improving heat recovery from a geothermal well, comprising:

receiving first temperature distribution data from a first distributed temperature sensing (DTS) system comprising a first fiber optic cable disposed in an injection wellbore, which extends through a formation;

receiving second temperature distribution data from a second DTS system comprising a second fiber optic cable disposed in a production wellbore, which extends through the formation and is in fluid communication with the injection wellbore via the formation;

determining a thermal efficiency profile between the injection wellbore and the production wellbore based on the first temperature distribution data and the second temperature distribution data, wherein the determining of the thermal efficiency profile comprises determining a set of temperature differences between points along the injection wellbore and points along the production wellbore, and wherein the set of temperature differences is used to generate the thermal efficiency profile;

determining a location of a local minimum of the thermal efficiency profile; and injecting a sealing agent into the formation at the location, wherein the sealing agent cures to seal fractures within a fracture system in the formation at the location, and wherein the cured sealing agent prevents or mitigates fluid flow through the formation at the location.

15. The method of claim 14, wherein the local minimum of the thermal efficiency profile corresponds to a local minimum of the set of temperature differences.

16. The method of claim 15, wherein the location of the local minimum of the thermal efficiency profile corresponds to a location of the local minimum of the set of temperature differences.

17. The method of claim 14, wherein the injection wellbore comprises a first horizontal section.

18. The method of claim 17, wherein the production wellbore comprises a second horizontal section.

19. The method of claim 18, wherein the second horizontal section is disposed deeper underground than the first horizontal section.

20. The method of claim 19, wherein the first horizontal section runs parallel to the second horizontal section.

* * * * *